US005415973A

United States Patent [19]

Inoue

[11] Patent Number: 5,415,973

[45] Date of Patent: May 16, 1995

[54] SILVER HALIDE PHOTOGRAPHIC MATERIAL

[75] Inventor: Nobuaki Inoue, Kanagawa, Japan

[73] Assignee: Fuji Photo Film Co., Ltd., Kanagawa, Japan

[21] Appl. No.: 123,082

[22] Filed: Sep. 17, 1993

Related U.S. Application Data

[63] Continuation of Ser. No. 781,836, Oct. 24, 1991, abandoned.

[30] Foreign Application Priority Data

Oct. 25, 1990 [JP] Japan ..... 2-287604

[51] Int. Cl.[6] ..... G03C 1/06

[52] U.S. Cl. ..... 430/264; 430/223; 430/611; 430/957

[58] Field of Search ..... 430/264, 223, 611, 957

[56] References Cited

U.S. PATENT DOCUMENTS

| | | | |
|---|---|---|---|
| 5,085,971 | 4/1992 | Katoh et al. | 430/264 |
| 5,116,723 | 5/1992 | Kajiwara et al. | 430/611 |
| 5,134,055 | 7/1992 | Okamura et al. | 430/264 |
| 5,139,921 | 8/1992 | Takagi et al. | 430/264 |
| 5,145,765 | 9/1992 | Okamura et al. | 430/264 |

FOREIGN PATENT DOCUMENTS

| | | |
|---|---|---|
| 0072140 | 3/1989 | Japan . |
| 00721410 | 3/1989 | Japan . |

*Primary Examiner*—Thomas R. Neville
*Attorney, Agent, or Firm*—Sughrue, Mion, Zinn, Macpeak & Seas

[57] ABSTRACT

A super-high contrast silver halide photographic material is disclosed, comprising a support having thereon at least one light-sensitive silver halide emulsion layer, wherein the emulsion layer or at least one other hydrophilic colloid layer contains at least one hydrazine derivative, at least one redox compound capable of releasing a development inhibitor by oxidation and at least one compound represented by formula (I):

Q—SM (I)

wherein Q represents a heterocyclic group containing at least one hydrophilic group bonded thereto directly or indirectly; and M represents a hydrogen atom, an alkali metal, a quaternary ammonium group or a quaternary phosphonium group. The material is suitable for photomechanical processes, giving sharp and super-high contrast line images and dot images with little black pepper therein. Enlargement or reduction of images is easy with the material.

13 Claims, No Drawings

SILVER HALIDE PHOTOGRAPHIC MATERIAL

This is a Continuation of application No. 07/781,836 filed Oct. 24, 1991, now abandoned.

FIELD OF THE INVENTION

The present invention relates to a silver halide photographic material and, in particular, to a super-high contrast silver halide photographic material to be used in photomechanical processes.

BACKGROUND OF THE INVENTION

In the field of photomechanical process technology, photographic materials with excellent original-reproducibility, stable processing solutions and simplified replenishment system are required to deal with diversified and complicated print forms.

Originals to be employed in a line image photography processing are often composed of phototypesetting letters, hand-writing letters, illustrations and halftone dot image photographs. Accordingly, on original contains several images having a different concentration and a different line width in combination. Photomechanical cameras and photographic materials suitable for obtaining images from such originals with good reproducibility, as well as image-forming methods applicable to such photographic materials, are needed in this technical field. On the other hand, in the photomechanical processes for producing catalogs or large-sized posters, the blow-up or reduction of dot image photographs is widely employed. In the photomechanical processes involving enlarged dot images, the dots may be coarsened to give blurred photoprints. As opposed to this, in the photomechanical processes involving reduced photoprints, fine dots with an enlarged ratio of lines/inch are to be photographed. Accordingly, an image-forming method with a much broader latitude is desired for the purpose of maintaining the reproducibility of halftone dot images in the photomechanical processes.

As the light source for a photomechanical camera, a halogen lamp or a xenon lamp is employed. In order to obtain a sufficient photographing sensitivity to the light source, the photographic material used in the photomechanical process is generally ortho-sensitized. However, it was found that the ortho-sensitized photographic materials are much more influenced by the chromatic aberrations of the lens and therefore the quality of the images formed is frequently reduced by those aberrations. It was also found that the deterioration of the image quality is more noticeable where a xenon lamp is used as the light source.

As a system of satisfying the demand for a broad latitude, a method is known where a lith-type silver halide photographic material composed of silver chlorobromide (having a silver chloride content of at least 50% or more) is processed with a hydroquinone-containing developer in which the effective concentration of the sulfite ion therein is drastically lowered (generally, to 0.1 mol/liter or less) to obtain thereby a line image or halftone dot image having a high contrast and a high blackened density in which the image portions and the non-image portions are clearly distinguished from each other. However, the method has various drawbacks. Specifically, since the sulfite concentration in the developer to be employed in the method is low, development is extremely unstable to aerial oxidation. For the purpose of stabilizing the activity of the processing solution, various means must be effected. The processing speed is extremely slow, and the working efficiency is poor under the current state of the art.

Accordingly, an improved image-forming system is desired, which is free from the instability in image formation in the above-mentioned development method (lith-development system) and which may be processed with a processing solution having an excellent storage stability, to give photographic images having super-high contrast photographic characteristics. As one example, a system of forming a super-high contrast negative image having a gamma value of more than 10 has been proposed, for example, in U.S. Pat. Nos. 4,166,742, 4,168,977, 4,221,857, 4,224,401, 4,243,739, 4,272,606 and 4,311,781. In that system, a surface latent image-type silver halide photographic material containing a particular acylhydrazine compound is processed with a developer which has an excellent storage stability and which contains a sulfite preservative in an amount of 0.15 mol/liter or more, under a pH of from 11.0 to 12.3. The proposed image-forming system is characterized by the fact that a silver iodobromide or silver chloroiodo-bromide-containing photographic material can be processed, although only a high silver chloride content silver chlorobromide photographic material can be processed by a conventional super-high contrast image-forming method.

The proposed image-forming system is excellent in that an image with a sharp halftone dot image quality is formed, the process proceeds stably at a high speed, and the reproducibility of the original is good. However, a further improved system with further elevated original reproducibility is still desired for the purpose of satisfactorily dealing with diversified print forms.

JP-A-61-213847 and 64-72140 illustrate examples of a photographic material system containing a hydrazine compound and also containing a redox compound capable of releasing a development inhibitor. (The term "JP-A" as used herein means an "unexamined published Japanese patent application".)

However, incorporation of a redox compound capable of releasing a development inhibitor into a super-high contrast photographic system containing a hydrazine compound results in the problem of a reduced gamma ($\gamma$) value. In order to obtain a sufficiently high contrast ($\gamma > 10$) in the super-high contrast photographic system, the amount of the hydrazine compound to be added thereto may be increased or a highly active hydrazine compound may be incorporated into the system or chemically sensitized silver halide emulsions may be used to constitute the system, but black pepper in the photographic material may occur.

On the other hand, examples of photographic materials of containing silver chlorobromide grains are described in JP-A-60-83028, 60-112034, 62-235947 and 63-103232.

SUMMARY OF THE INVENTION

One object of the present invention is to provide a silver halide photographic material which may form line images and dot images of good quality, and with which enlargement or reduction of images formed in the material may well be effected with ease.

Another object of the present invention is to provide a silver halide photographic material which results in little black pepper.

These and other objects of the present invention have been attained by a silver halide photographic material comprising a support having thereon at least one light-sensitive silver halide emulsion layer, wherein the emulsion layer or at least one other hydrophilic colloid layer contains at least one hydrazine derivative, at least one redox compound capable of releasing a development inhibitor by an oxidation product of a developing agent and at least one compound represented by formula (I):

$$Q—SM \quad (I)$$

wherein Q represents a heterocyclic group containing at least one hydrophilic group bonded thereto directly or indirectly; and M represents a hydrogen atom, an alkali metal, a quaternary ammonium group or a quaternary phosphonium group.

DETAILED DESCRIPTION OF THE INVENTION

Photographic materials containing both a hydrazine nucleating agent and a heterocyclic compound containing a water-soluble group and techniques for development-processing a photographic material containing a hydrazine nucleating agent in the presence of a heterocyclic compound containing a water-soluble group are described in, for example, JP-A-61-52640, 61-122642, 62-212651, 62-237445, 63-103232, 2-839 and 63-103232.

However, these patent specifications do not disclose a technique for combining a hydrazine nucleating agent and a redox compound capable of releasing a development inhibitor by an oxidation product of a developing agent in processing a super-high contrast photographic material.

Compounds of formula (I) for use in the present invention will be explained in detail hereunder.

The hydrophilic group moiety in Q in formula (I) is preferably $—SO_3M$, $—SO_2NHR^1$, $—NHCONHR^1$, $—NHSO_2R^1$, $—CO_2NHR^1$, $—NHCOR^1$, $—PO_3M$, —COOM or —OH, wherein $R^1$ is a hydrogen atom or an alkyl group having from 1 to 5 carbon atoms, and M has the same meaning as defined in formula (I).

Examples of heterocyclic group represented by Q in formula (I) include an oxazole ring, a thiazole ring, an imidazole ring, a selenazole ring, a triazole ring, a tetrazole ring, a thiadiazole ring, an oxadiazole ring, a pentazole ring, a pyrimidine ring, a thiazine ring, a triazine ring, or a thiadiazine ring; or a residue of a condensed ring with another carbon ring or hetero ring, such as a benzothiazole ring, a benzotriazole ring, a benzimidazole ring, a benzoxazole ring, a benzoselenazole ring, a naphthoxazole ring, a triazaindolidine ring, a diazaindolidine ring, or a tetraazaindolidine ring.

Among the mercapto-heterocyclic compounds represented by formula (I), especially preferred are those of the following formulae (IV), (V) and (VI):

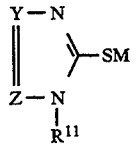

(IV)

-continued

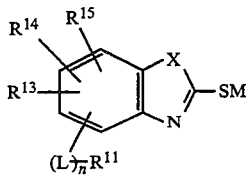

(V)

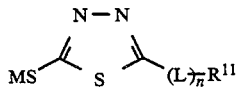

(VI)

In formula (IV), Y and Z each represents N or $CR^{12}$ (wherein $R^{12}$ represents a hydrogen atom, a substituted or unsubstituted alkyl group, or a substituted or unsubstituted aryl group).

$R^{11}$ represents an organic group substituted by at least one group selected from the group consisting of $—SO_3M$, —COOM, $—SO_2NHR^1$, $—NHCONHR^1$, $—NHSO_2R^1$, $—CO_2NHR^1$, $—NHCOR^1$, $—PO_3M$ and OH wherein $R^1$ and M have the same meaning as defined in formula (I). Examples of the organic group represented by $R^{11}$ include an alkyl group having from 1 to 20 carbon atoms (e.g., methyl, ethyl, propyl, hexyl, dodecyl, octadecyl), an aryl group having from 6 to 20 carbon atoms (e.g., phenyl, naphthyl), or an alkyl or aryl group containing a linking group such as —S—, —O—, —N=, —CO—, —SO— or $—SO_2—$.

Such alkyl and aryl groups may further be substituted by substituent(s) selected from a halogen atom (e.g., F, Cl, Br), an alkoxy group (e.g., methoxy, methoxyethoxy), an aryloxy group (e.g., phenoxy), an alkyl group (when $R^{11}$ is an aryl group), an aryl group (when $R^{11}$ is an alkyl group), an amide group (e.g., acetamide), a carbamoyl group (e.g., methylcarbamoyl), a sulfonamide group (e.g., methanesulfonamide), a sulfamoyl group (e.g., methylsulfamoyl), a sulfonyl group (e.g., methylsulfonyl), a sulfinyl group (e.g., methylsulfinyl), a cyano group, an alkoxycarbonyl group (e.g., methoxycarbonyl), an aryloxycarbonyl group (e.g., phenoxycarbonyl), and a nitro group.

When $R^{11}$ has two or more substituents selected from $—SO_3M$, —COOM, $—SO_2NHR^1$, $—NHCONHR^1$, $—NHSO_2R^1$, $—CO_2NHR^1$, $—NHCOR^1$, $—PO_3M$ and —OH, the substituents may be same or different.

M has the same meaning as defined in formula (I), and $R^1$ has the same meaning as defined in formula (I).

In formula (V), X represents a sulfur atom, an oxygen atom, a selenium atom or $—N(R^{16})—$ (wherein $R^{16}$ represents a hydrogen atom, a substituted or unsubstituted alkyl group (preferably having 1 to 20 carbon atoms), or a substituted or unsubstituted aryl group (preferably having 6 to 20 carbon atoms)); L represents $—CONR^{17}—$, $—NR^{17}CO—$, $—SO_2NR^{17}—$, $—NR^{17}SO_2—$, —OCO—, —COO—, —S—, $—NR^{17}—$, —CO—, —SO—, —OCOO—, $—NR^{17}CONR^{18}—$, $—NR^{17}COO—$, $—OCONR^{17}—$ or $—NR^{17}SO_2NR^{18}—$ (wherein $R^{17}$ and $R^{18}$ each represents a hydrogen atom, a substituted or unsubstituted alkyl group (preferably having 1 to 20 carbon atoms), or a substituted or unsubstituted aryl group (preferably having 6 to 20 carbon atoms)); $R^{11}$ and M have the same meaning as defined in formulae (I) and (IV); and n represents 0 or 1.

$R^{13}$, $R^{14}$ and $R^{15}$ each represent a hydrogen atom or a substitutable group. The term "substitutable group" has the same meaning as the organic groups such as the substituted or unsubstituted alkyl and aryl groups defined for $R^{11}$.

When the benzene ring moiety of formula (V) has two or more substitutable groups of $R^{13}$, $R^{14}$ and $R^{15}$, the substitutable groups may be same or different. When two substitutable groups are bonded to adjacent carbon atoms on the benzene ring moiety, they may also be bonded to each other to form a 5-membered to 7-membered, saturated or unsaturated carbon ring or hetero ring.

Examples of the ring-forming compounds include cyclopentane, cyclohexane, cycloheptane, cyclopentene, cyclohexadiene, cycloheptadiene, indane, norbornene, benzene and pyridine, which may further be substituted.

The alkyl or aryl groups represented by $R^{12}$, $R^{13}$, $R^{14}$, $R^{15}$, $R^{16}$, $R^{17}$ or $R^{18}$ may also be substituted by substituent(s). Such substituents may be selected from the above-mentioned substituents for the alkyl or aryl groups for $R^{11}$.

In formula (VI), X, $R^{11}$, (L), n have the same meaning as defined in formula (V).

Examples of compounds represented by formula (I), which are preferably used in the present invention are shown below.

I-1

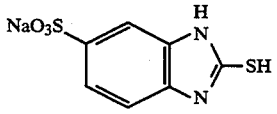

I-2

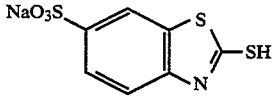

I-3

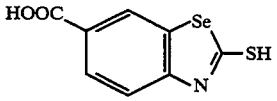

I-4

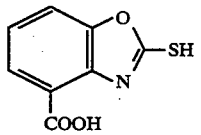

I-5

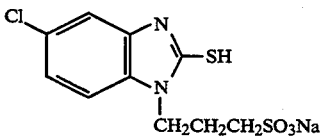

I-6

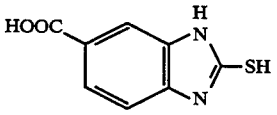

I-7

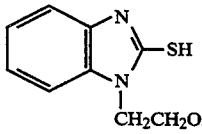

-continued

I-8

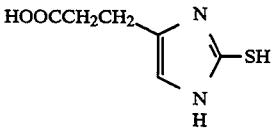

I-9

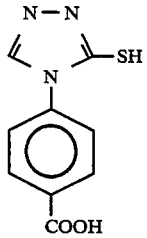

I-10

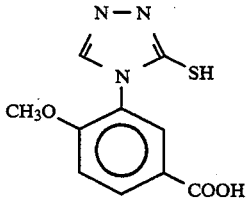

I-11

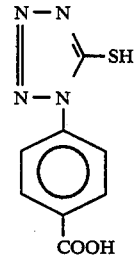

I-12

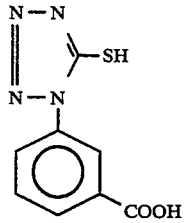

I-13

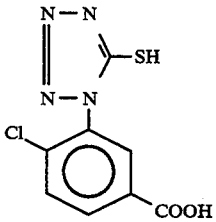

I-14

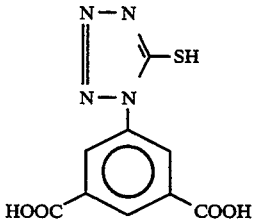

-continued
I-15
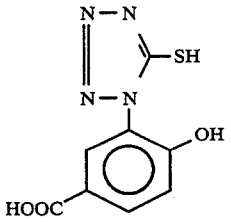
I-16
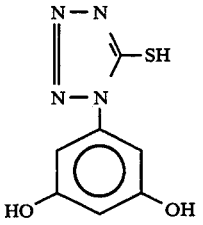
I-17
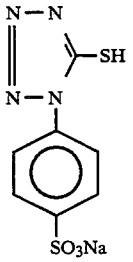
I-18
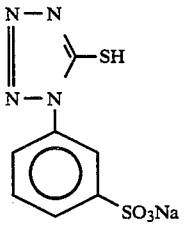
I-19
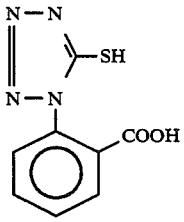
I-20
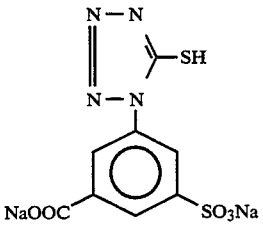
I-21
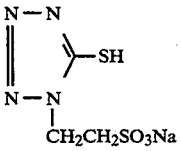
-continued
I-22
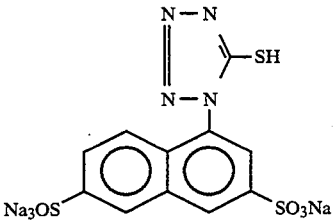
I-23
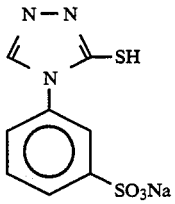
I-24
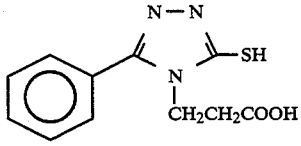
I-25
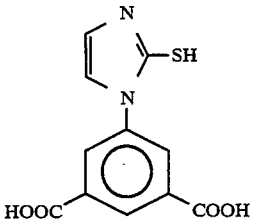
I-26
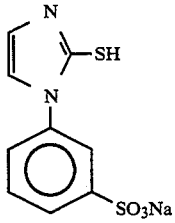
I-27
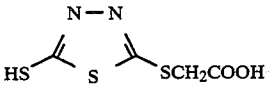
I-28
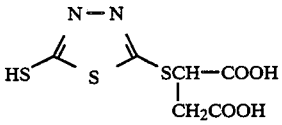
I-29
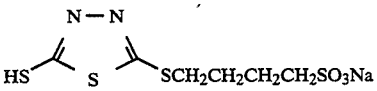
I-30
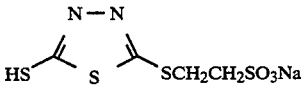
I-31
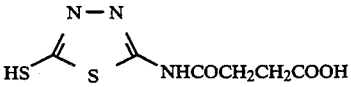

-continued
I-32
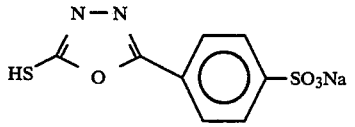
I-33
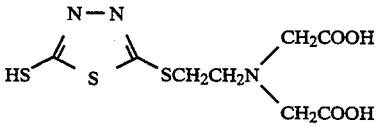
I-34
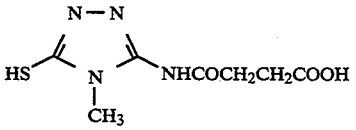
I-35
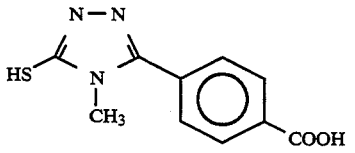
I-36
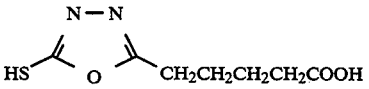
I-37
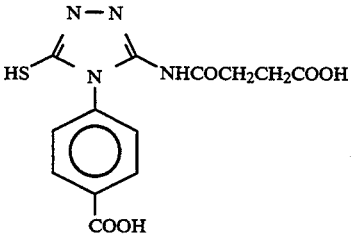
I-38
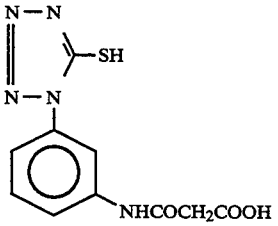
I-39
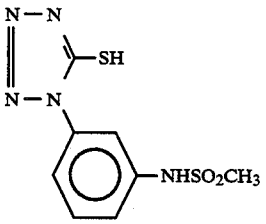
I-40
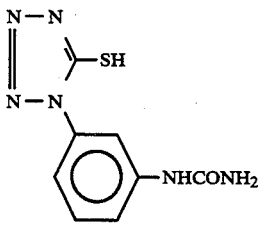
-continued
I-41
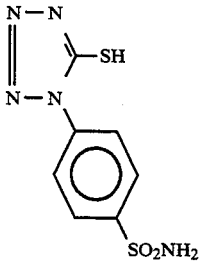
I-42
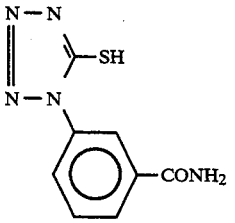
I-43
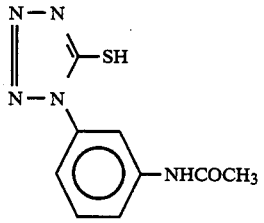
I-44
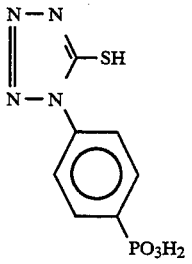
I-45
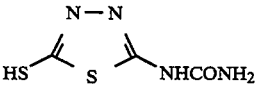
I-46
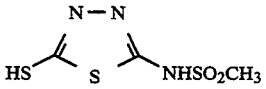
I-47
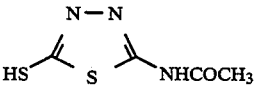
I-48
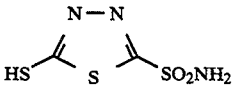
I-49
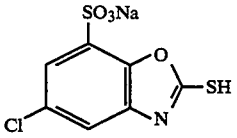

-continued

I-50

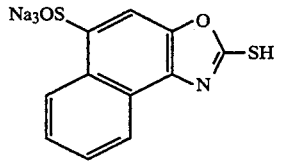

I-51

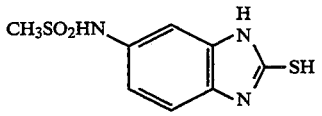

Compounds represented by formula (I) can be produced by known methods, for example, those described in the following literature references:

U.S. Pat. Nos. 2,585,388, 2,541,924, JP-B-42-21842 (the term "JP-B" as used herein means an "examined Japanese patent publication"), JP-A-53-50169, and British Patent 1,275,701;

D. A. Berges et al., *Journal of Heterocyclic Chemistry,* Vol. 15, No. 981 (1978), *The Chemistry of Heterocyclic Chemistry,* "Imidazole and Derivatives", Part I, pages 336 to 339;

*Chemical Abstract,* 58, 7921 (1963), page 394;

E. Hoggarth, *Journal of Chemical Society,* pages 1160 to 1167 (1949);

S. R. Sandler, W. Karo, *Organic Functional Group Preparation* (published by Academic Press), pages 312 to 315 (1968);

I. I. Kovtunouskaya Levshine, *Tr. Ukr. Inst. Eksperim Endokrinol,* Vol. 18, page 345 (1961);

M. Chamdon, et al., *Bull, Chem. Fr.,* 723 (1954);

D. A. Shirley, D. W. Alley, *J. Amer. Chem. Soc.,* 79, 4922 (1954);

A. Wchl, W. Marchwald, *Ber.* (*Journal of Chemical Society of Germany*), Vol. 22, page 568 (1889);

Praphalla Chandra Guha, *J., Amer. Chem. Soc.,* 44, pages 1502 to 1510 (1922);

U.S. Pat. No. 3,017,270, British Patent 940,169, JP-B-49-8334, JP-A-55-59463;

*Advanced in Heterocyclic Chemistry.,* 9, 165 to 209 (1968);

Khim, Geterotsikl, *Soedin.,* 7 (7), 905 to 909;

German Patent 2,716,707;

*The Chemistry of Heterocyclic Compounds, Imidazole and Derivatives,* vol. 1, page 384;

*Org., Synth. IV.,* 569 (1963);

L. B. Sebrell, C. E. Booed, *J. Amer. Chem. Soc.,* 45, 2390 (1923); and

JP-A-50-89034, 53-28426, 55-21007, 57-202531, 57-116340, JP-B-40-28496.

The amount of the compound represented by formula (I) incorporated into the photographic material of the present invention is from $1.0\times10^{-5}$ mol to $5.0\times10^{-2}$ mol, preferably from $5\times10^{-5}$ mol to $5\times10^{-3}$ mol, per mol of silver in the material. The compound represented by formula (I) can be incorporated into the material in the form of an aqueous solution thereof or a solution thereof which is dissolved in an organic solvent such as an alcohol (e.g., methanol, ethanol), ketones (e.g., acetone) or an ester (e.g., ethyl acetate). The compound of formula (I) may be added to a silver halide emulsion during its preparation (for example, it may be added thereto during formation of emulsion grains or during chemical ripening of them), or may be added to a coating composition prepared for coating.

The hydrazine derivatives incorporated into the photographic material of the present invention include compounds represented by formula (II):

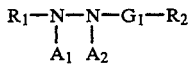

(II)

wherein $R_1$ represents an aliphatic group or an aromatic group;

$R_2$ represents a hydrogen atom, an alkyl group, an aryl group, an alkoxy group, an aryloxy group, an amino group, or a hydroxyl group;

$G_1$ represents —CO—, —$SO_2$—, —SO—, —$R_2$PO—,

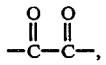

a thiocarbonyl group, or an iminomethylene group; and $A_1$ and $A_2$ are both hydrogen atoms, or one of them represents a hydrogen atom and the other represents a substituted or unsubstituted alkylsulfonyl group, a substituted or unsubstituted arylsulfonyl group, or a substituted or unsubstituted acyl group.

In formula (II), the aliphatic group represented by $R_1$ is preferably one having from 1 to 30 carbon atoms and is especially preferably a linear, branched or cyclic alkyl group having from 1 to 20 carbon atoms. The alkyl group may optionally be substituted.

In formula (II), the aromatic group represented by $R_1$ is preferably a monocyclic or dicyclic aryl or unsaturated heterocyclic group. The unsaturated heterocyclic group may be condensed with one or more aryl groups.

$R_1$ is more preferably an aryl group, especially preferably one containing benzene ring(s).

The aliphatic group or aromatic group represented by $R_1$ may optionally be substituted. Typical substituents include, for example, an alkyl group, an aralkyl group, an alkenyl group, an alkynyl group, an alkoxy group, an aryl group, a substituted amino group, an ureido group, an urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric acid amide group, a diacylamino group, an imido group, and

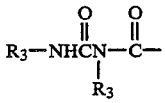

wherein $R_3$ has the same meaning as $R_2$ in formula (II). Preferred substituents among these are an alkyl group (preferably having from 1 to 20 carbon atoms), an aralkyl group (preferably having from 7 to 30 carbon atoms), an alkoxy group (preferably having from 1 to 20 carbon atoms), a substituted amino group (preferably an amino group substituted by one or more alkyl groups having from 1 to 20 carbon atoms), an acylamino group (preferably having from 2 to 30 carbon atoms), a sulfonamide group (preferably having from 1 to 30 carbon atoms), an ureido group (preferably having from 1 to 30 carbon atom), and a phosphoric acid amide group (preferably having from 1 to 30 carbon atoms).

In formula (II), the alkyl group represented by $R_2$ is preferably an alkyl group having from 1 to 4 carbon atoms; and the aryl group represented by $R_2$ is preferably a monocyclic or dicyclic aryl group (for example, containing one or more benzene rings).

When $G_1$ is —CO—, $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, 2-hydroxymethylphenyl), and especially preferably a hydrogen atom.

$R_2$ may optionally be substituted. Examples of the substituents for $R_2$ include the substituents for $R_1$.

In formula (II), $G_1$ is most preferably —CO—.

$R_2$ may be such that it cleaves the moiety $G_1$—$R_2$ from the molecule of formula (II) to bring cyclization, forming a cyclic structure containing the atoms of the —$G_1$—$R_2$ moiety. Examples of that are mentioned, for example, in JP-A-63-29751.

$A_1$ and $A_2$ are most preferably hydrogen atoms.

$R_1$ or $R_2$ in formula (II) may contain a ballast group or polymer which is commonly in passive photographic additives such as couplers. The ballast group referred to herein is a group which has 8 or more carbon atoms and which is relatively inactive to photographic properties. For instance, it includes an alkyl group, an alkoxy group, a phenyl group, an alkylphenyl group, a phenoxy group, and alkylphenoxy group. Examples of the polymer referred to herein include those described in JP-A-1-100530.

$R_1$ or $R_2$ in formula (II) may contain a group having the function of enhancing the adsorbability of the molecule of the formula to the surfaces of silver halide grains. Examples of such adsorbing groups include thiourea groups, heterocyclic thioamide groups, mercaptoheterocyclic groups and triazole groups described in U.S. Pat. Nos. 4,385,108, 4,459,347, JP-A-59-195233, 59-200231, 59-201045, 59-201046, 59-201047, 59-201048, 59-201049, 61-170733, 61-270744, 62-948, 63-234244, 63-234246 and Japanese Patent Application No. 62-67501.

Specific examples of compounds represented by formula (II) for use in the present invention are mentioned below, which, however, are not intended to restrict the scope of the present invention.

II-1

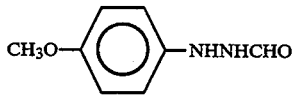

II-2

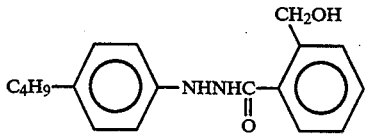

II-3

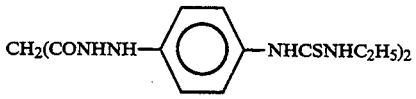

II-4

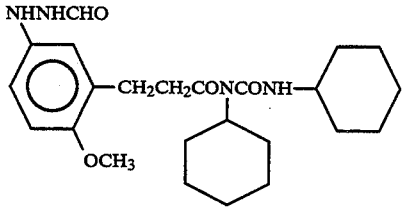

II-5

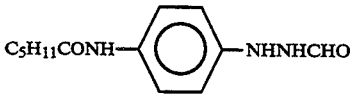

II-6

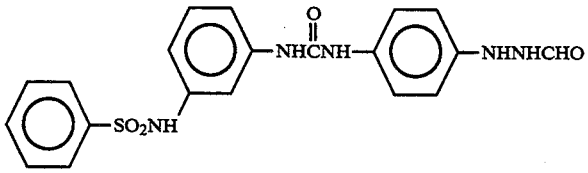

II-7

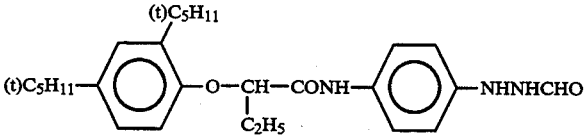

-continued
II-8
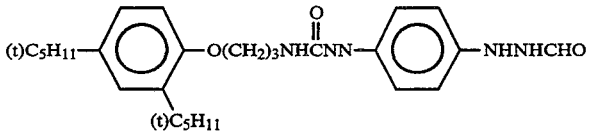
II-9
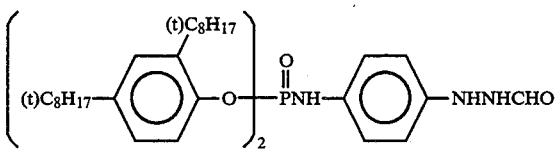
II-10
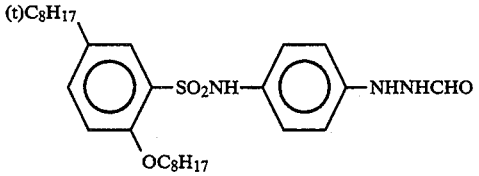
II-11
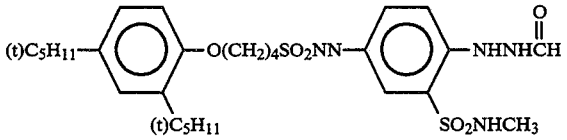
II-12
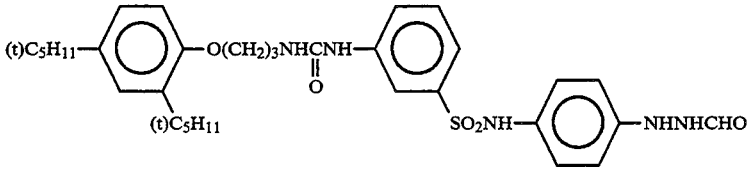
II-13
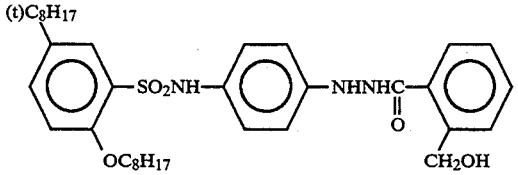
II-14
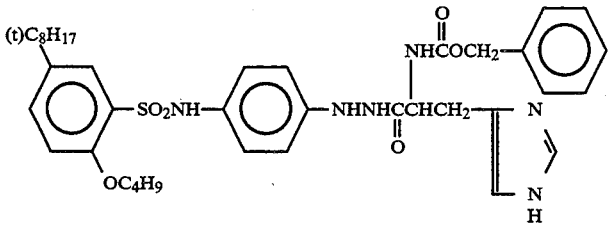
II-15
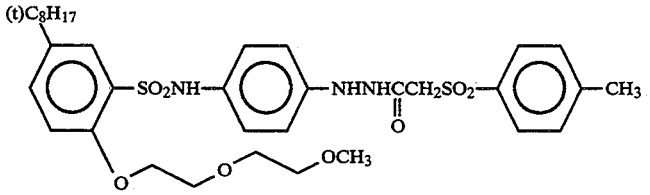
II-16
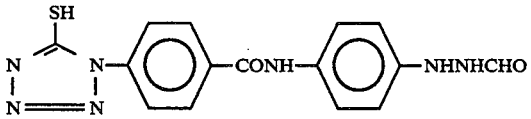

-continued
II-17
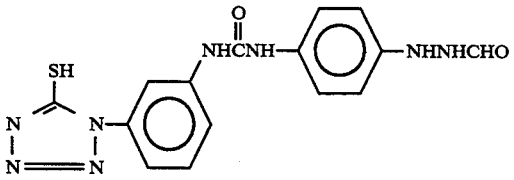
II-18
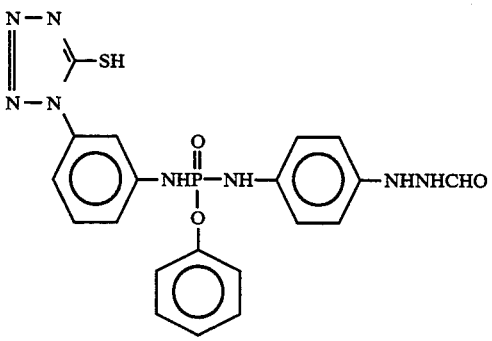
II-19
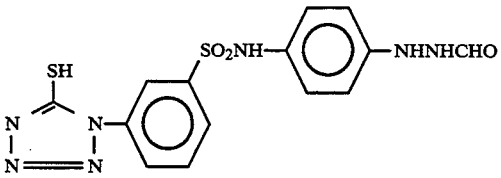
II-20
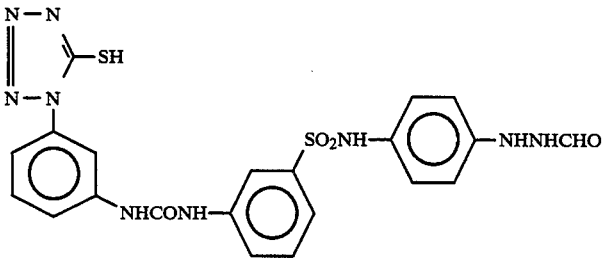
II-21
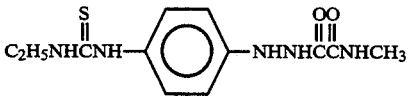
II-22
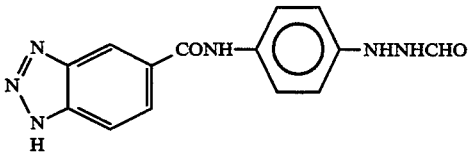
II-23
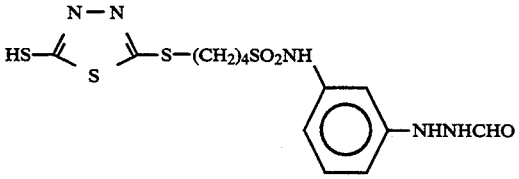

-continued

II-24

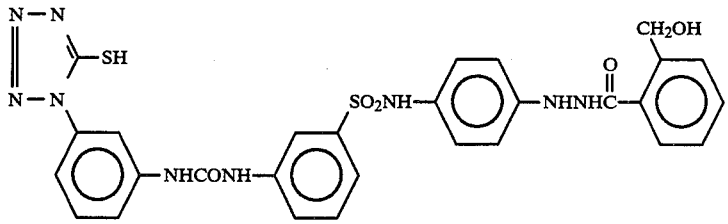

II-25

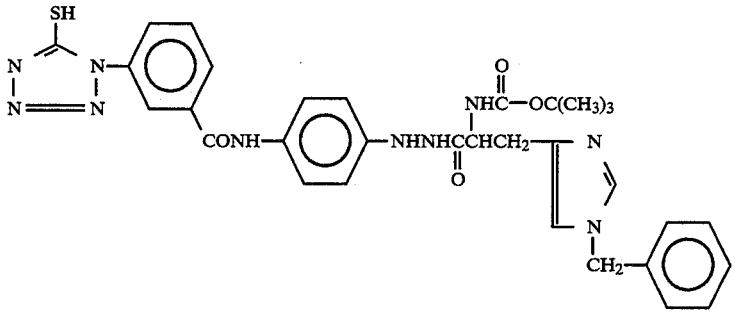

II-26

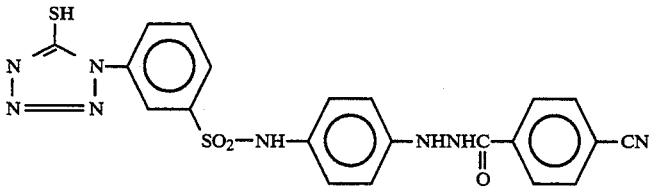

Hydrazine derivatives in addition to those mentioned above, which may be used in the present invention include those described in RESEARCH DISCLOSURE No. 23516 (November, 1983, page 346) and the literature references referred to therein, as well as those described in U.S. Pat. Nos. 4,080,207, 4,269,929, 4,276,364, 4,278,748, 4,385,108, 4,459,347, 4,560,638, 4,478,928, British Patent 2,011,391B, JP-A-60-179734, 62-270948, 63-29751, 61-170733, 61-270744, 62-948, EP 217,310, U.S. Pat. No. 4,686,167, JP-A-62-178246, 63-32538, 63-104047, 63-121838, 63-129337, 63-223744, 63-234244, 63-234245, 63-234246, 63-294552, 63-306438, 1-100530, 1-105941, 1-105943, 64-10233, 1-90439, 2-139538, 1-276128, 1-283548, 1-280747, 1-283549, 1-285940, 2-2541, 2-77057, 2-198440, 2-198441, 2-198442, 2-196234, 2-196235, 2-220042, 2-221953, 2-221954, 2-302750 and 2-304550.

The amount of the hydrazine derivative added to the photographic material of the present invention is preferably from $1\times10^{-6}$ mol to $5\times10^{-2}$ mol, especially preferably from $1\times10^{-5}$ mol to $2\times10^{-2}$ mol, per mol of silver halide in the material.

The redox compounds capable of releasing a development inhibitor by an oxidation product of a developing agent in the photographic material of the present invention, will be explained in detail hereunder.

Examples of the redox group in redox compounds include hydroquinones, catechols, naphthohydroquinones aminophenols, pyrazolidones, hydrazines, hydroxylamines and reductones. More preferably, among these, hydrazines is preferred.

Hydrazines which can be used in the present invention as redox compounds capable of releasing a development inhibitor by oxidation are preferably those represented by the following formulae (R-1), (R-2) and (R-3). The compounds of formula (R-1) are especially preferred among them.

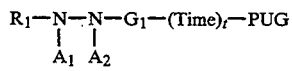

(R-1)

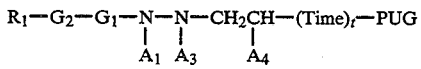

(R-2)

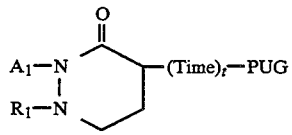

(R-3)

In these formulae, $R_1$ represents an aliphatic group, an aromatic group or an unsaturated heterocyclic group. $G_1$ represents —CO—,

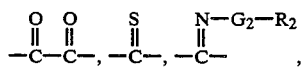

—SO—, —$SO_2$— or

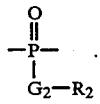

$G_2$ represents a mere chemical bond or represents —O—, —S— or —$NR_2$—, and $R_2$ represents a hydrogen atom or has the same meaning as $R_1$.

$A_1$ and $A_2$ each represents a hydrogen atom, an alkylsulfonyl group, an arylsulfonyl group or an acyl group, which may be substituted. In formula (R-1), at least one of $A_1$ and $A_2$ must be a hydrogen atom. $A_3$ has the same meaning as $A_1$ or represents —$CH_2$—C($A_4$)H—(Time)$_t$—PUG.

$A_4$ represents a nitro group, a cyano group, a carboxyl group, a sulfo group or —$G_1$—$G_2$—$R_1$.

Time represents a divalent linking group; and t represents 0 or 1. PUG represents a development inhibitor.

Formulae (R-1), (R-2) and (R-3) will be explained in more detail hereunder.

In formulae (R-1), (R-2) and (R-3), the aliphatic group represented by $R_1$ is preferably a group having from 1 to 30 carbon atoms. Especially preferably, it is a linear, branched or cyclic alkyl group having from 1 to 20 carbon atoms. The alkyl group may optionally be substituted.

In formulae (R-1), (R-2) and (R-3), the aromatic group represented by $R_1$ is preferably a monocyclic or dicyclic aryl or unsaturated heterocyclic group. The unsaturated heterocyclic group may optionally be condensed with one or more aryl groups to form a heteroaryl group.

For instance, the aryl group may be composed of a benzene ring, a naphthalene ring, a pyridine ring, a quinoline ring and/or an isoquinoline ring. Especially preferably, it contains one or more benzene rings.

$R_1$ is especially preferably an aryl group.

The aryl group or unsaturated heterocyclic group represented by $R_1$ may optionally be substituted. Typical substituents which are substituted to the aryl group or unsaturated heterocyclic group include an alkyl group, an aralkyl group, an alkenyl group, an alkynyl group, an alkoxy group, an aryl group, a substituted amino group, an ureido group, an urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, and a phosphoric acid amide group. Among these, preferred are a linear, branched or cyclic alkyl group (preferably having from 1 to 20 carbon atoms), an aralkyl group (preferably having from 7 to 30 carbon atoms), an alkoxy group (preferably having from 1 or 30 carbon atoms), a substituted amino group (preferably an amino group as substituted by one or more alkyl groups having from 1 to 30 carbon atoms), an acylamino group (preferably having from 2 to 40 carbon atoms), a sulfonamide group (preferably having from 1 to 40 carbon atoms), an ureido group (preferably having from 1 to 40 carbon atoms), and a phosphoric acid amide group (preferably having from 1 to 40 carbon atoms).

$G_1$ in formulae (R-1), (R-2) and (R-3) is preferably —CO— or —$SO_2$—, and most preferably, —CO—.

$A_1$ and $A_2$ are preferably hydrogen atoms; and $A_3$ is preferably a hydrogen atom or —$CH_2$—C($A_4$)H—(Time)$_t$—PUG.

In formulae (R-1), (R-2) and (R-3),Time represents a divalent linking group, which may have a timing-adjusting function.

The divalent linking group represented by Time is a group capable of releasing PUG from the moiety Time-PUG to be released from the oxidation product of the redox nucleus, by a one step reaction or via a reaction of several steps.

Examples of the divalent linking group, Time include the p-nitro-phenoxy derivatives capable of releasing PUG by the intramolecular ring-closure reaction as described in U.S. Pat. No. 4,248,962 (JP-A-54-145135); the compounds capable of releasing PUG by ring-cleavage reaction followed by intramolecular ring-closure reaction as described in U.S. Pat. No. 4,310,612 (JP-A-55-53330) and U.S. Pat. No. 4,358,252; the succinic acid monoesters or analogues thereof capable of releasing PUG by intramolecular ring-closure reaction capable of the carboxyl group along with formation of an acid anhydride, as described in U.S. Pat. Nos. 4,330,617, 4,446,216 and 4,483,919 and JP-A-59-121328; the compounds capable of releasing PUG by electron transfer of the aryloxy or heterocyclic-oxy group via a conjugated double bond to form a quinomonomethane or an analogue thereof, as described in U.S. Pat. Nos. 4,409,232, 4,421,845, RESEARCH DISCLOSURE No. 21,228 (December, 1981), U.S. Pat. No. 4,416,977 (JP-A-57-135944) and JP-A-58-209736 and 58-209738; the compounds capable of releasing PUG by electron transfer of the enamine structure moiety of the nitrogen-containing hetero ring from the gamma-position of the enamine, as described in U.S. Pat. No. 4,420,554 (JP-A-57-136640), JP-A-57-135945, 57-188035, 58-98728 and 58-209737; the compounds capable of releasing PUG by intramolecular ring-closure reaction of the hydroxyl group formed by electron transfer of the carbonyl group conjugated with the nitrogen atom of the nitrogen-containing hetero ring, as described in JP-A-57-56837; the compounds capable of releasing PUG during formation of aldehydes as described in U.S. Pat. No. 4,146,396 (JP-A-52-90932), JP-A-59-93442, 59-75475, 60-249148 and 60-249149; the compounds capable of releasing PUG with decarbonylation of the carboxyl group, as descried in JP-A-51-146828, 57-179842 and 59-104641; the compounds having —O—COOC$R_a$$R_b$—PUG (where $R_a$ and $R_b$ independently represent a monovalent group) and releasing PUG by decarbonylation followed by the formation of aldehydes; the compounds capable of releasing PUG during formation of isocyanates, as described in JP-A-60-7429; and the compounds capable of releasing PUG by a coupling reaction with the oxidation product of a color developing agent, as described in U.S. Pat. No. 4,438,193.

Examples of the divalent linking groups represented by Time are also described in JP-A-61-236549 and 1-269936.

PUG represents a group having a development-inhibiting activity as (Time)$_t$—PUG or as PUG.

The development inhibitor represented by PUG or (Time)$_t$—PUG may be a known development inhibitor containing hetero atoms, and it is bonded to the formula via the hetero atom of PUG. Examples of such a development inhibitor are described, for example, in C. M. E. Mees and T. H. James, *The Theory of Photographic Processes,* 3rd Ed. (published by Macmillan Co., 1966), pages 344 to 346.

The development inhibitor of PUG may optionally be substituted. Examples of the substituents include those mentioned as substituents for $R_1$ in formula (II). The substituents may further be substituted.

Preferred substituents are a nitro group, a sulfo group, a carboxyl group, a sulfamoyl group, a phosphono group, a phosphinyl group and a sulfonamide group.

In formulae (R-1), (R-2) and (R-3), $R_1$ or —(Time)$_t$—PUG may have a ballast group which is commonly used in immovable photographic additives such as couplers or may also have a group capable of accelerating adsorption of the compound of formula (R-1), (R-2) or (R-3) to silver halides, if desired.

The ballast group suitable for this purpose is an organic group which will give a sufficient molecular weight to the compound of formula (R-1), (R-2) or (R-3) so that the compound could not substantially diffuse to the other layers or to processing solutions. It is composed of one or more of an alkyl group, an aryl group, a heterocyclic group, an ether group, a thioether group, an amide group, an ureido group, an urethane group and a sulfonamide group. Preferably, the ballast group is generally a substituted benzene ring-having ballast group, especially preferably a branched alkyl group-substituted benzene ring-containing ballast group.

The group having a function of accelerating adsorption of the compound of formula (R-1), (R-2) or (R-3) to silver halides may be, for example, cyclic thioamide groups such as 4-thiaozline-2-thione, 4-imidaozline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidaozline-2-thione; linear thioamide groups; aliphatic mercapto groups; aromatic mercapto groups; heterocyclic mercapto groups (when a nitrogen atom is adjacent to the carbon atom bonded to —SH, the groups have the same meaning as the cyclic thioamide groups which are tautomers of the groups, and specific examples of the groups are same as those mentioned above); disulfido bond-containing groups, 5-membered or 6-membered nitrogen-containing heterocyclic groups composed of a combination of nitrogen, oxygen, sulfur and carbon atoms, such as benzotriazoles, triazoles, tetrazoles, indazoles, benzimidazoles, imidazoles, benzothiazoles, thiazoles, thiazolines, benzoxazoles, oxazoles, oxazolines, thiadiazoles, oxathiazoles, triazines, azaindenes; as well as heterocyclic quaternary salts such as benzimidazoliums.

These groups may further be substituted by suitable substituent(s), if desired.

Examples of the substituents include those mentioned for the $R_1$ group of formula (II).

Specific examples of the compounds of the above-mentioned formulae (R-1), (R-2) and (R-3) which are suitable in the present invention are mentioned below, which, however, are not limiting.

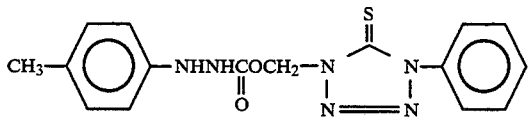

III-1

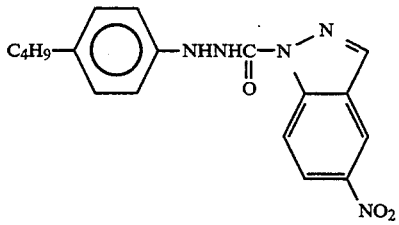

III-2

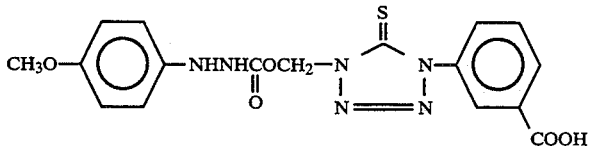

III-3

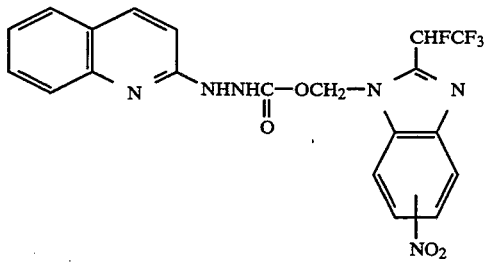

III-4

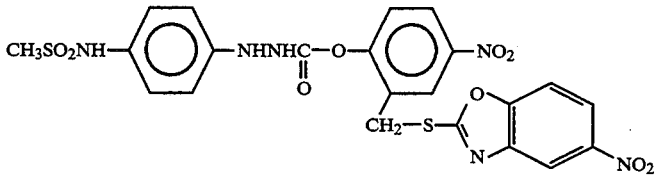

III-5

-continued
III-6
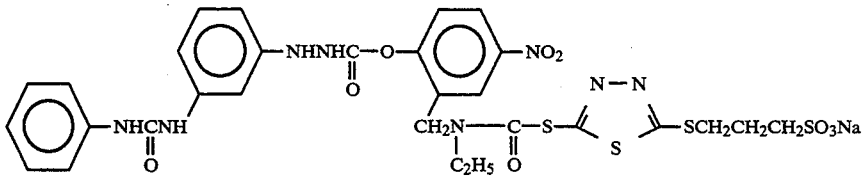
III-7
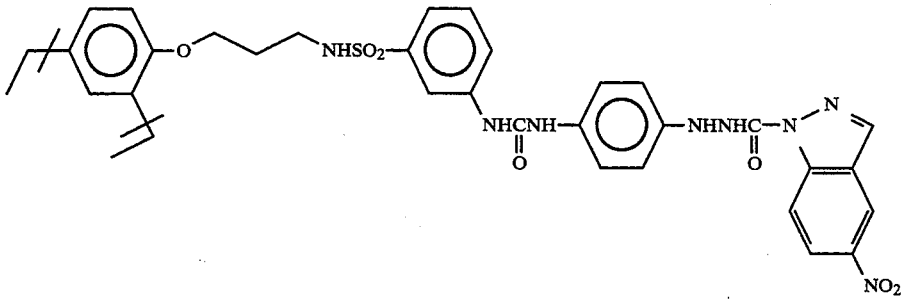
III-8
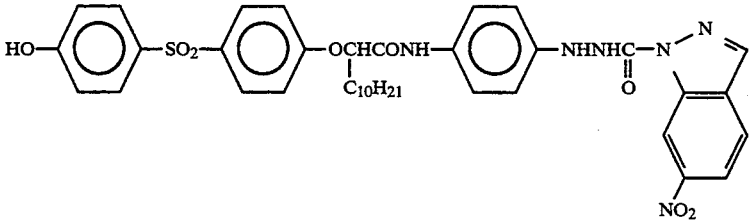
III-9
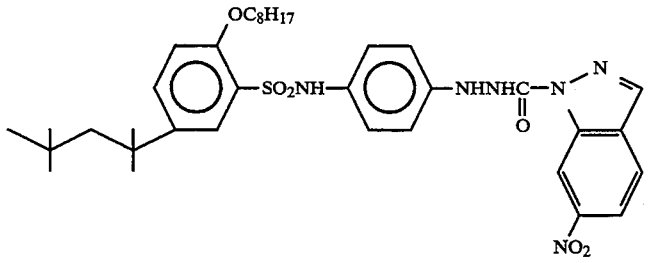
III-10
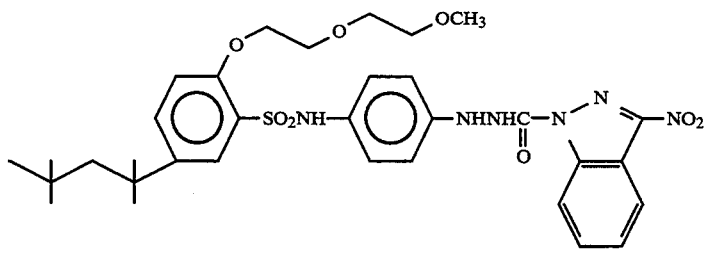
III-11
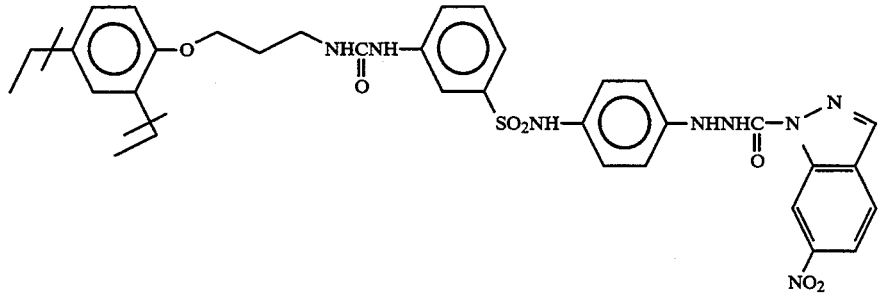

-continued
III-12
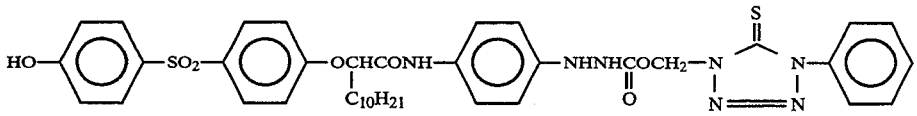
III-13
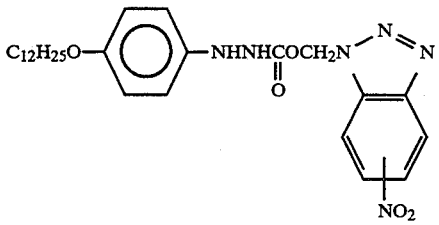
III-14
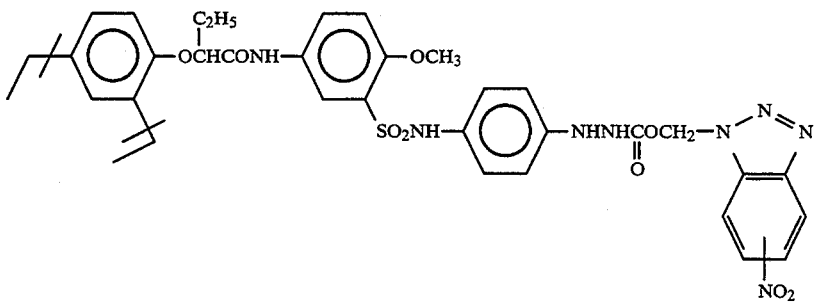
III-15
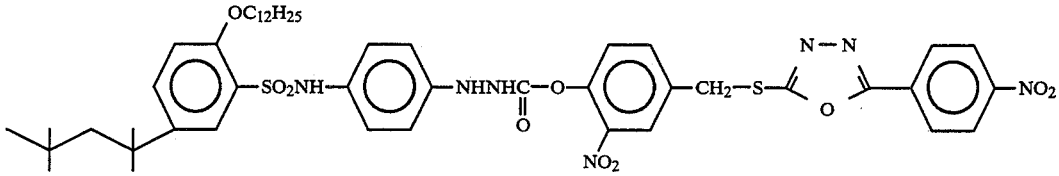
III-16
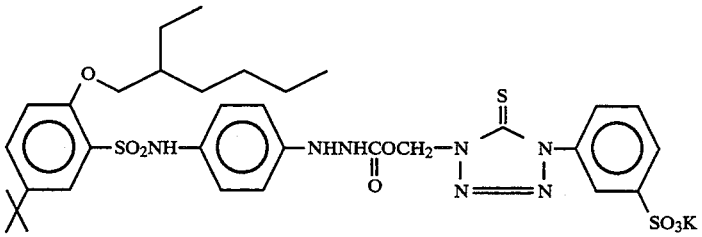
III-17
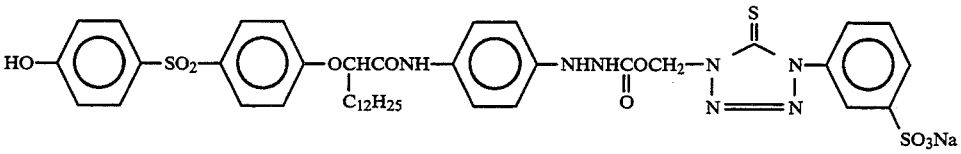
III-18
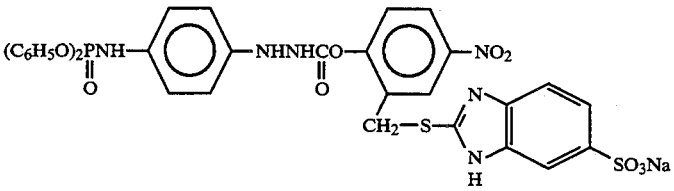
III-19
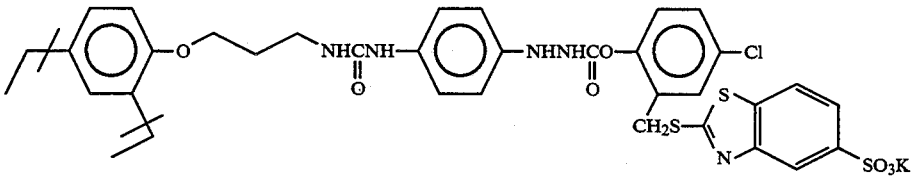

-continued
III-20
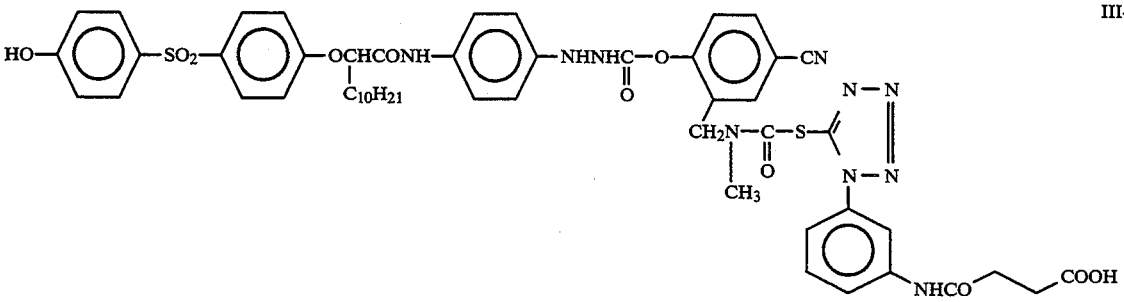
III-21
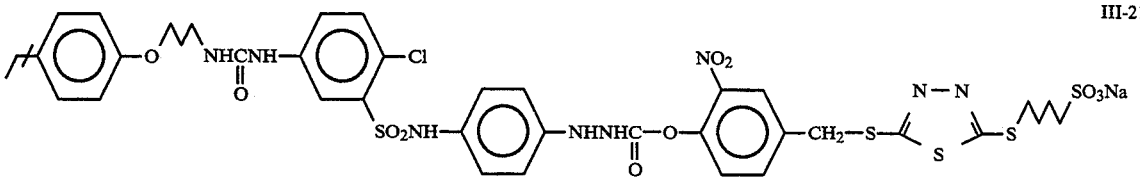
III-22
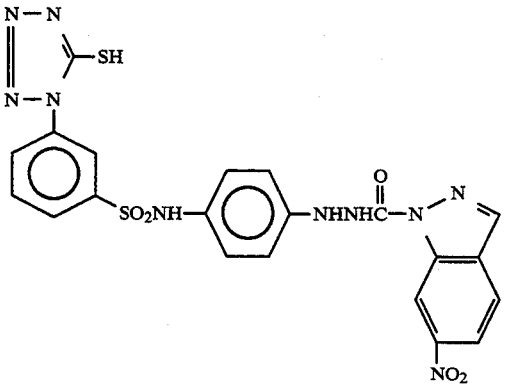
III-23
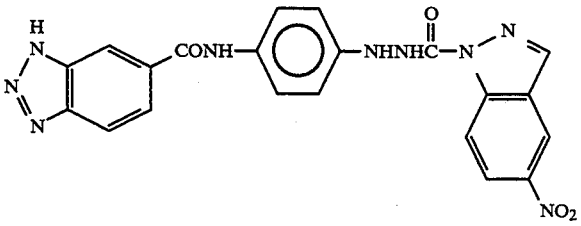
III-24
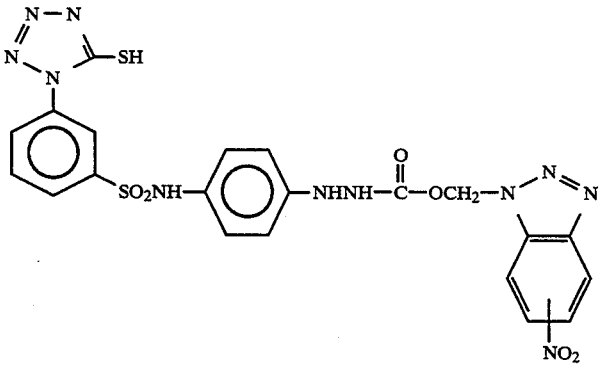
III-25
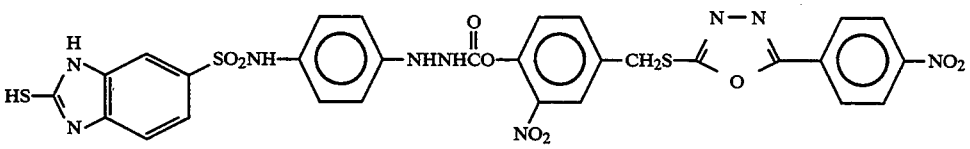

-continued
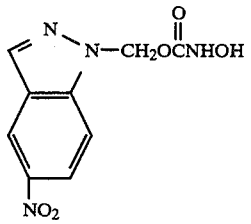
III-26
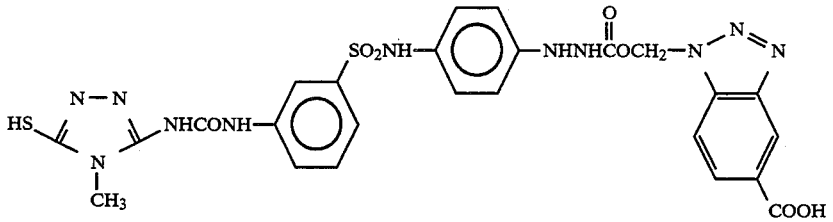
III-27
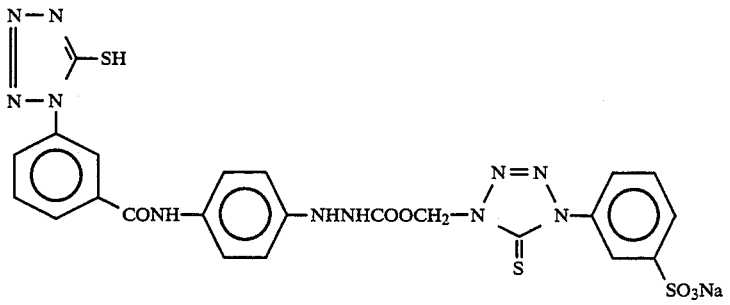
III-28
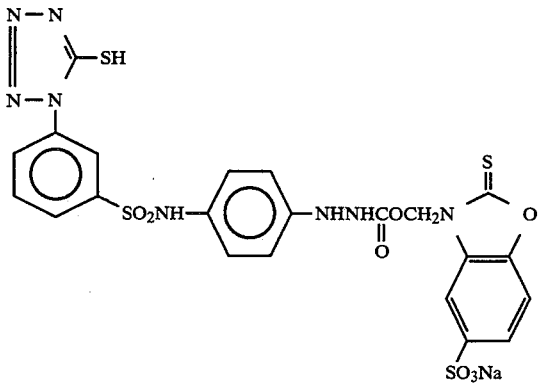
III-29
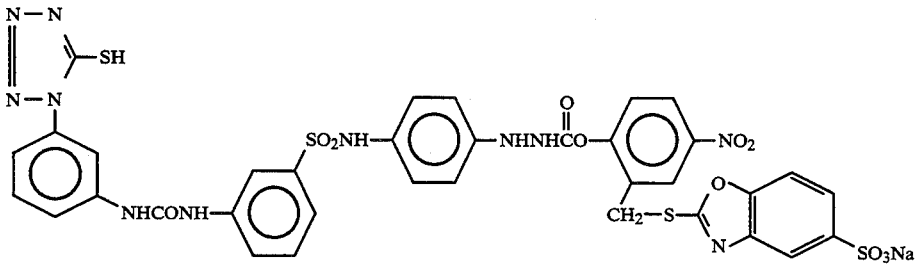

-continued
III-30
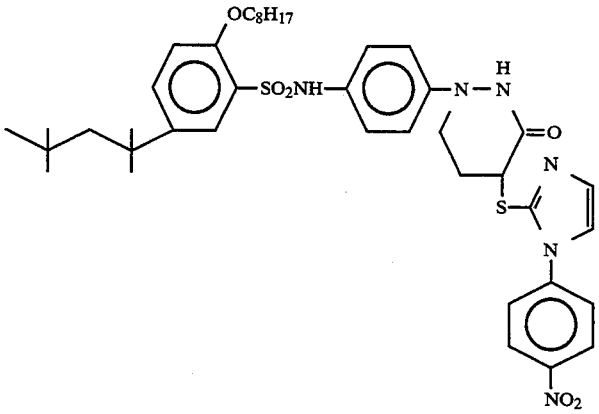
III-31
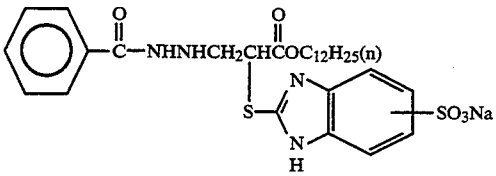
III-32
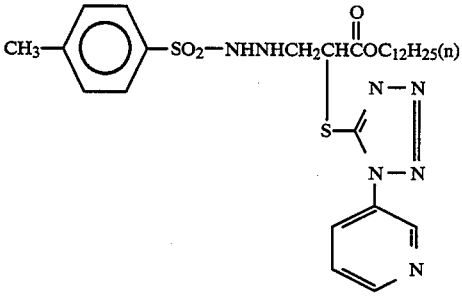
III-33
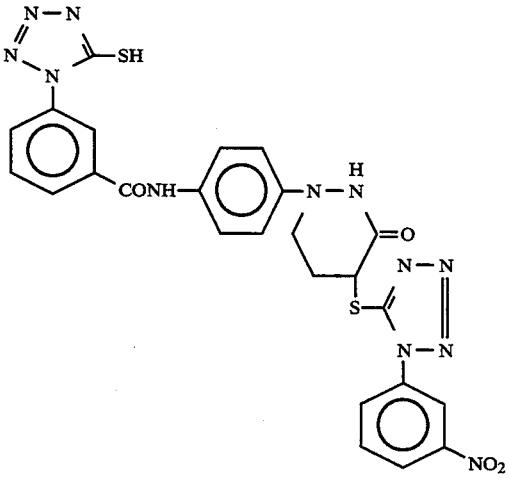
III-34
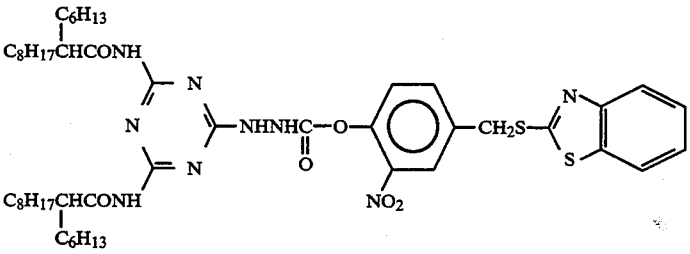

-continued

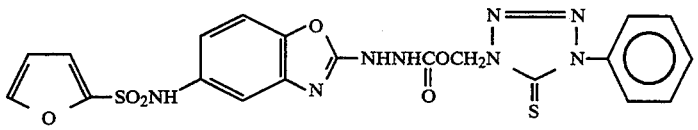

III-35

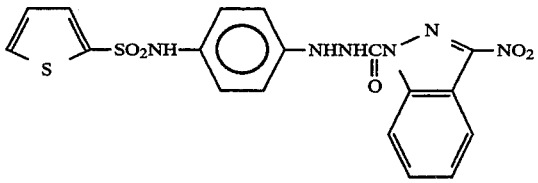

III-36

The redox compounds suitable in the present invention include in addition to those mentioned above, those described in JP-A-61-213847, 62-260153, 3-39953, 3-39951, 3-39949 and 3-67246.

Methods of preparing redox compounds suitable in the present invention are described, for example, in JP-A-61-213847, 62-260153, 1-269936 U.S. Pat. No. 4,684,604, U.S. Pat. Nos. 3,379,529, 3,620,746, 4,377,634, 4,322,878, JP-A-49-129536, 56-153336, 56-153342.

The amount of redox compound(s) to be used in the photographic material of the present invention can be from $1\times10^{-6}$ to $5\times10^{-2}$ mol, more preferably from $1\times10^{-5}$ to $1\times10^{-2}$ mol, per mol of silver halide in the material.

For incorporating the redox compound into the photographic material of the present invention, one may dissolve it in a suitable water-miscible organic solvent, for example, alcohols (e.g., methanol, ethanol, propanol, fluorinated alcohols), ketones (e.g., acetone, methyl ethyl ketone), dimethylformamide, dimethylsulfoxide, or methyl cellosolve.

In another technique, the compound may be mechanically formed into an emulsified dispersion by means of a well known emulsifying and dispersing method using an oil such as dibutyl phthalate, tricresyl phosphate, glyceryl triacetate or diethyl phthalate and an auxiliary solvent such as ethyl acetate or cyclohexanone. In still another technique, a powder of the redox compound may be dispersed in water by a ball mill or colloid mill or by the action of ultrasonic waves, or means of a well-known solid dispersing method.

The silver halides constituting the photographic material of the present invention are preferably in the form of monodispersed silver halide emulsions. The emulsions are not specifically restricted with respect to halogen composition. Preferably, the halogen composition of the emulsions is desired to have a silver chloride content of 50 mol % or more; and either silver chlorobromide or silver iodochlorobromide is desired in which the silver iodide content is preferably 3 mol % or less, more preferably 0.5 mol % or less.

For preparing monodispersed silver halide emulsions for use in the present invention, various methods which are well known in this technical field can be employed. For instance, the methods described in P. Glafkides, *Chimie et Physique Photographique* (published by Paul Montel, 1967); G. F. Duffin, *Photoqraphic Emulsion Chemistry* (published by The Focal Press, 1966); V. L. Zelikman et al., *Making and Coating Photographic Emulsion* (published by The Focal Press, 1964) can be employed.

The monodispersed silver halide emulsions for use in the present invention are desired to have a fluctuation coefficient of 20% or less, especially preferably 15% or less.

The fluctuation coefficient is defined by the following formula:

Fluctuation Coefficient (%) =

[(Standard Deviation of Grain Size)/(Mean Grain Size)] × 100

Grains of the constituent monodispersed silver halide emulsions for use in the present invention have a mean grain size of 0.5 μm or less, especially preferably from 0.1 μm to 0.4 μm.

The silver halide grains constituting the photographic materials of the present invention may be formed by a method of reacting a water-soluble silver salt (e.g., in the form of an aqueous silver nitrate solution) and water-soluble halide(s). For performing this method, a single jet method, a double jet method or a combination thereof can be employed. As one example of a double jet method, a so-called controlled double jet method is possible, in which the pAg value of the aqueous phase of the forming silver halide grains is kept constant throughout the reaction. Use of a so-called silver halide solvent such as ammonia, thioether or tetra-substituted thioureas in the step of forming the silver halide grains is preferred.

More preferably, tetra-substituted thiourea compounds are used, which are described in JP-A-53-82408 and 55-77737. Preferred thiourea compounds for this purpose are tetramethylthiourea and 1,3-dimehtyl-2-imidazolidinethione.

By a controlled double jet method or a method involving a silver halide solvent, it is easy to produce silver halide grains having a regular crystalline form and having a narrow grain size distribution. Accordingly, the two methods are advantageous for forming emulsions to be used in the present invention.

The silver halide grains in the monodispersed emulsions for use in the present invention are desired to have a regular crystalline form, such as a cubic, octahedral or tetradecahedral crystalline form. Especially preferred is a cubic crystalline form.

The silver halide grains for use in the present invention may have either a uniform phase in the inside and the surface parts or different uniform phases.

In preparing the silver halide emulsions for use in the present invention, a cadmium salt, a sulfite salt, a lead salt, a thallium salt, a rhodium salt or a complex salt thereof, or an iridium salt or a complex salt thereof may be added to the reaction system in the step of forming silver halide grains or in the step of physically ripening the grains.

Silver halide emulsions which are especially suitable for forming line image-taking or dot image-taking photographic materials of the present invention are those which are prepared in the presence of from $10^{-8}$ to $10^{-5}$ mol per mol of silver of an iridium salt or a complex salt thereof.

In that case, it is desired that such an iridium salt or a complex salt thereof in the above-mentioned amount is added to the reaction system of forming silver halide grains before finish of physical ripening of the grains, especially during the step of forming the grains.

Examples of the iridium salt to be used in that case include a water-soluble iridium salt or iridium complex salt such as iridium trichloride, iridium tetrachloride, potassium hexachloroiridate(III), potassium hexachloroiridate(IV) and ammonium hexachloroiridate(III).

The monodispersed emulsions for use in the present invention are desired to be chemically sensitized. Any of the known methods for sulfur sensitization, reduction sensitization and/or gold sensitization can be employed therefor, singly or in combination of them. Gold-sulfur sensitization is preferred for chemical sensitization of the emulsions.

The sulfur sensitizing agents to be used in sulfur sensitization include sulfur compounds contained in gelatin, as well as other various sulfur compounds, such as thiosulfates, thioureas, thiazoles, and rhodanines. Examples of suitable sulfur sensitizing agents are described in, for example, U.S. Pat. Nos. 1,574,944, 2,278,947, 2,410,689, 2,728,668, 3,501,313 and 3,656,955. Preferred sulfur compounds for sulfur sensitization are thiosulfates and thiourea compounds. During chemical sensitization, the reaction system is desired to have a pAg value of 8.3 or less, more preferably from 7.3 to 8.0. A method of using both a polyvinyl pyrrolidone and a thiosulfate, as reported in *Moisar, Klein Gelatine, Proc. Syme.*, 2nd, 301 to 309 (1970), may also be employed to yield a good result.

Gold sensitization is typical as noble metal sensitization method, in which gold compounds, especially gold complexes, are used. Complexes of noble metals other than gold, such as platinum, palladium or iridium, may also be incorporated into the gold sensitization system. Examples of such a gold sensitization method are described in U.S. Pat. No. 2,448,060 and British Patent 618,061.

As a binder or protective colloid in photographic emulsions constituting the photographic materials of the present invention, gelatin is advantageously used. Additionally, any other hydrophilic colloids may also be used. For instance, suitable are proteins such as gelatin derivatives, graft polymers of gelatin and other polymers, albumin and casein; cellulose derivatives such as hydroxyethyl cellulose, carboxymethyl cellulose and cellulose sulfates; saccharide derivatives such as sodium alginate and starch derivatives; as well as other various synthetic hydrophilic homopolymers or copolymers such as polyvinyl alcohol, polyvinyl alcohol partial acetal, poly-N-vinylpyrrolidone, polyacrylic acid, polymethacrylate, polyacrylamide, polyvinylimidazole and polyvinyl pyrazole.

A lime-processed gelatin as well as acid-processed gelatin may be used. In addition, gelatin hydrolysates and enzyme-decomposed products of gelatin may also be used.

To the photographic materials of the present invention, one can add sensitizing dyes having an absorption peak in the visible ray range, for example, those described in JP-A-55-52050, pages 45 to 53 (e.g., cyanine dyes, merocyanine dyes). By addition of such sensitizing dyes, the materials may be spectrally sensitized to a longer wavelength range than the intrinsic sensitivity range of the silver halides therein.

Such sensitizing dyes can be used singly or in combination of two or more of them. Combinations of sensitizing dyes are often employed for the purpose of supersensitization. Along with sensitizing dyes, dyes which do not have a color-sensitizing activity by themselves or substances which do not substantially absorb visible rays but display supersensitization can also be added to the emulsions constituting the photographic materials of the present invention.

Suitable sensitizing dyes, combinations of dyes displaying supersensitization and substances displaying supersensitization are described in *Research Disclosure*, Vol. 176, No. 17643 (December, 1978), page 23, Item IV-J.

The photographic materials of the present invention may contain various compounds for the purpose of preventing fog during manufacture, storage and processing of the materials or for the purpose of stabilizing photographic properties of the materials. Specifically, suitable compounds include these which are known as an antifoggant or stabilizer, for example, azoles such as benzothiazolium salts, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles, and nitrobenzotriazoles; mercaptopyrimidines; mercaptotriazines; thioketo compounds, such as oxazolinethione; azaindenes, such as triazaindenes, tetrazaindenes (especially, 4-hydroxy-substituted (1,3,3a,7)tetrazaindenes), and pentaazaindenes; as well as benzenethiosulfonic acids, benzenesulfinic acids and benzenesulfonic acid amides. Among them, especially preferred are benzotriazoles (e.g., 5-methylbenzotriazole) and nitroindazoles (e.g., 5-nitroindazole). Such compounds can also be added to processing solutions to be used for processing the photographic materials of the present invention. In addition, compounds capable of releasing an inhibitor during development, such as-those described in JP-A-62-30243, may also be added to the photographic materials of the present invention as a stabilizer or for the purpose of preventing the formation of black pepper.

The photographic materials of the present invention can contain a stabilizer, hydroquinone derivatives as an accelerator, as well as phenidone derivatives as a developing agent.

The photographic materials of the present invention can contain an inorganic or organic hardening agent in the photographic emulsion layers or in any other hydrophilic colloid layers. For instance, suitable as the agent are chromium salts (e.g., chromium alum, chromium acetate), aldehydes (e.g., formaldehyde, glutaraldehyde), N-methylol compounds (e.g., dimethylolurea), dioxane derivatives, active vinyl compounds (e.g., 1,3,5-triacryloyl-hexahydro-s-triazine, 1,3-vinylsulfonyl-2-propanol), and active halogen compounds (e.g., 2,4-dichloro-6-hydroxy-s-triazine), mucohalogenic acids (e.g., mucochloric acid), singly or in combination of two or more.

The photographic material of the present invention can contain various surfactants, in the photographic emulsion layers or in any other hydrophilic colloid layers, for the purpose of coating aid, for prevention of static charges, for improvement of sliding property, for improvement of emulsification and dispersion, for prevention of adhesion and for improvement of photographic properties (e.g., acceleration of development, elevation of contrast, sensitization).

Suitable nonionic surfactants include saponins (steroid type ), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglycerides, alkylphenol polyglycerides), and alkyl esters such as esters of fatty acids with polyalcohols; anionic surfactants containing an acid group such as a carboxyl group, a sulfo group, a phospho group, a sulfate group or a phosphate group, for example, alkylcarboxylic acid salts, alkylsulfonic acid salts, alkylbenzenesulfonic acid salts, alkylnaphthalenesulfonic acid salts, alkylsulfate esters, alkylphosphate esters, N-acyl-N-alkyltaurins, sulfosuccinate esters, sulfoalkyl-polyoxyethylene alkylphenyl ethers, and polyoxyethylene alkylphosphate esters; amphoteric surfactants such as amino acids, aminoalkylsulfonic acids, aminoalkylsulfate or phosphate esters, alkylbetaines, and amine oxides; and cationic surfactants, for example, alkylamine salts, aliphatic or aromatic quaternary ammonium salts, heterocyclic quaternary ammonium salts such as pyridinium or imidazolium salts, and aliphatic or heterocyclic phosphonium or sulfonium salts.

The surfactants which are preferably used in the present invention are polyalkylene oxides having a molecular weight of 600 or more, as described in JP-B-58-9412.

For the prevention of static charge, the addition of fluorine-containing surfactants as described in JP-A-60-80849 to the photographic materials of the present invention is preferred.

The photographic materials of the present invention can contain hydroquinone derivatives capable of releasing a development inhibitor in accordance with the density of the developed image (so-called DIR-hydroquinones), in the photographic emulsion layers or in any other hydrophilic colloid layers.

Specific examples of such compounds include the compounds described in U.S. Pat. Nos. 3,379,529, 3,620,746, 4,377,634 and 4,332,878, and JP-A-49-129536, 54-67419, 56-153336, 56-153342, 59-278853, 59-90435, 59-90436 and 59-138808.

The photographic materials of the present invention can contain a mat agent, such as silica, magnesium oxide or polymethyl methacrylate, in the photographic emulsion layers or in any other hydrophilic colloid layers for the purpose of preventing adhesion.

The photographic materials of the present invention can contain a dispersion of a water-insoluble or sparingly water-soluble synthetic polymer to improve dimension stability of the materials. For instance, suitable stabilizers are homopolymers or copolymers of alkyl (meth)acrylates, alkoxyalkyl (meth)acrylates and/or glycidyl (meth)acrylates, as well as copolymers composed of such monomer(s) and other comonomer(s) of acrylic acid and methacrylic acid.

The photographic materials of the present invention are desired to contain compounds which contain an acid group in the silver halide emulsion layers and other layers. Suitable acid group-containing compounds include organic acids such as salicylic acid, acetic acid or ascorbic acid, as well as polymers or copolymers having repeating units derived from acid monomers such as acrylic acid, maleic acid or phthalic acid. Disclosures of the compounds are in JP-A-61-223834, 61-228437, 62-25745 and 62-55642. Above all, preferred is ascorbic acid as a low molecular compound, as well as an aqueous dispersion latex of a copolymer composed of an acid monomer (such as acrylic acid) and a crosslinking monomer having two or more unsaturated groups (such as divinylbenzene) as a high molecular compound.

In preparing the photographic materials of the present invention, the emulsions mentioned above are coated on a suitable support, for example, glass, cellulose acetate film, polyethylene terephthalate film, paper, baryta-coated paper or polyolefin-coated paper.

In order to obtain super-high contrast photographic images with high sensitivity, using the silver halide photographic material of the present invention, it is unnecessary to use a conventional infectious developer or a high alkali developer having a pH value of about 13 as described in U.S. Pat. No. 2,419,975, but any stable developer can be used.

Specifically, the silver halide photographic material of the present invention can be processed well with a developer having a pH value of from 10.5 to 12.3, especially from 11.0 to 12.0, and containing, as a preservative, sulfite ions, to give a sufficiently super-high contrast negative image.

The developing agent in the developer which is used in processing the photographic material of the present invention is not specifically restricted, but the developer is desired to contain dihydroxybenzenes in order to easily form images having a good dot quality. As the case may be, a combination of dihydroxybenzenes and 1-phenyl-3-pyrazolidones, or a combination of dihydroxybenzenes and p-aminophenols may also be employed.

Examples of dihydroxybenzene developing agents suitable for processing the photographic materials of the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Especially preferred is hydroquinone.

1-Phenyl-3-pyrazolidone and derivatives thereof may also be used as a developing agent in the present invention. Examples thereof include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of p-aminophenol developing agents suitable in the present invention include N-methyl-p-aminophenol, p-aminophenol, N-(β-hydroxyethyl)-p-aminophenol, N-(4-hydroxyphenyl) glycine, 2-methyl-p-aminophenol, and p-benzylaminophenol. Among these, preferred is N-methyl-p-aminophenol.

The amount of the developing agent in the developer for use in the present invention is generally preferably from 0.05 mol/liter to 0.8 mol/liter. When a combination of dihydroxybenzenes and 1-phenyl-3-pyrazolidones or p-aminophenols is employed, it is preferred that the content of the former in the developer is from 0.05 mol/liter to 0.5 mol/liter and that of the latter therein is 0.06 mol/liter or less.

The developer for use in the present invention can contain, as a preservative, a sulfite such as sodium sulfite, potassium sulfite, lithium sulfite, ammonium sulfite, sodium bisulfite, potassium metabisulfite or formaldehyde-sodium bisulfite. The content of such a sulfite is preferably 0.15 mol/liter or more, especially preferably 0.5 mol/liter or more. The upper limit of the sulfite content is desirably up to 2.5 mol/liter.

The developer may contain an alkali agent for the purpose of properly adjusting the pH value thereof. A suitable alkali agent is a pH adjusting agent or a pH buffer, such as sodium hydroxide, potassium hydroxide, sodium carbonate, potassium carbonate, sodium tertiary phosphate, or potassium tertiary phosphate. The pH value of the developer is accordingly adjusted to between 10.5 and 12.3.

The developer may further contain any other additives in addition to the above-mentioned components. Such additives include, for example, a development inhibitor such as boric acid, borax, sodium bromide, potassium bromide or potassium iodide; an organic solvent such as ethylene glycol, diethylene glycol, triethylene glycol, dimethylformamide, methyl cellosolve, hexylene glycol, ethanol or methanol; an antifoggant or black pepper inhibitor such as indazole compounds (e.g., 1-phenyl-5-mercaptotetrazole, 5-nitroindazole) or benzotriazole compounds (e.g., 5-methylbenzotriazole); and optionally a color toning agent, a surfactant, a defoaming agent, a hard water softener, a hardening agent, and amino compounds described in JP-A-56-106244.

The developer for use in the present invention can contain, as a silver stain inhibitor, the compounds described in JP-A-56-24347. As a dissolution aid added to the developer, the compounds described in Japanese Patent Application No. 60-109743 can be used. Additionally, as a pH buffer added to the developer, the compounds described in JP-A-60-93433 and compounds described in JP-A-62-186259 can also be used.

As a fixing agent used in processing the developed photographic materials of the present invention, any conventional agent can be used. For instance, thiosulfates and thiocyanates and other organic sulfur compounds which are known to be effective as a fixing agent can be used. The fixer for the present invention can contain, as a hardening agent, a water-soluble aluminium compound (e.g., aluminium sulfate, alum). The amount of the water-soluble aluminium salt in the fixer may be generally from 0.4 to 2.0 g (Al)/liter. Additionally, the fixer may also contain, as an oxidizing agent, a ferric compound, such as an ethylenediaminetetraacetate/ferric complex.

The development temperature is selected from the range between 18° C. and 50° C., more preferably between 25° C. and 43° C.

Next, the present invention will be explained in more detail by way of the following examples, which, however, are not intended to restrict the scope of the present invention. In the following examples, a developer comprising the components mentioned below was used for processing the samples.

| Composition of Developer: | |
|---|---|
| Hydroquinone | 50.0 g |

-continued

| Composition of Developer: | |
|---|---|
| N-methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidaozle-5-sulfonic Acid | 0.3 g |
| Sodium 3-(5-mercaptotetrazole) benzenesulfonate | 0.2 g |
| N-n-butyldiethanolamine | 15.0 g |
| Sodium Toluenesulfonate | 8.0 g |
| Water to make | 1 liter |
| Potassium Hydroxide to make | pH of 11.6 |

EXAMPLE 1

Preparation of Emulsion (A):

An aqueous 0.13M silver nitrate solution and an aqueous halide solution containing $1\times10^{-7}$ mol per mol of silver of $(NH_4)_3RhCl_6$ and $2\times10^{-7}$ mol per mol of silver of $K_3IrCl_6$ and containing 0.04M of potassium bromide and 0.09M of sodium chloride were added to an aqueous gelatin solution containing sodium chloride and 1,3-dimethyl-2-imidazolidinethione, with stirring at 38° C. over a period of 12 minutes, by a double jet method. Silver chlorobromide grains were formed having a mean grain size of 0.15 82 m and a silver chloride content of 70 mol %, by nucleation. Subsequently, an aqueous 0.87M silver nitrate solution and an aqueous halide solution containing 0.26M of potassium bromide and 0.65M of sodium chloride were added thereto by the same double jet method over a period of 20 minutes.

Next, $1\times10^{-3}$ mol of KI solution was added to the silver halide emulsion for halogen-conversion, and the resulting emulsion was washed with water by conventional flocculation. Forty g of gelatin was added thereto, and the resulting emulsion was adjusted to have pH of 6.5 and pAg of 7.5. Eight mg per mol of silver of sodium benzenethiosulfonate, 5 mg per mol of silver of sodium thiosulfate and 8 mg per mol of silver of chloroauric acid were added to the emulsion, which was then heated at 60° C. for 60 minutes for chemical sensitization. As a stabilizer, 150 mg of 1,3,3a,7-tetraazaindene was added thereto. The grains thus formed were cubic silver chlorobromide grains having a mean grain size of 0.27 μm and a silver chloride content of 70 mol %. The emulsion had a grain size fluctuation coefficient of 10%.

Preparation of Emulsion (B):

An aqueous 0.13M silver nitrate solution and an aqueous halide solution containing $1\times10^{-7}$ mol per mol of silver of $(NH_4)_3RhCl_6$ and $2\times10^{-7}$ mol per mol of silver of $K_3IrCl_6$ and containing 0.052M of potassium bromide and 0.078M of sodium chloride were added to an aqueous gelatin solution containing sodium chloride and 1,3-dimethyl-2-imidazolidinethione, with stirring at 45° C. over a period of 12 minutes, by a double jet method. Silver chlorobromide grains were formed having a mean grain size of 0.15 μm and a silver chloride content of 60 mol %, by nucleation. Subsequently, an aqueous 0.87M of silver nitrate solution and an aqueous halide solution containing 0.34M of potassium bromide and 0.52M of sodium chloride were added thereto by the same double jet method over a period of 20 minutes.

Next, $1\times10^{-3}$ mol of KI solution was added to the silver halide emulsion for halogen-conversion, and the resulting emulsion was washed with water by conventional flocculation. Forty g of gelatin was added thereto, and the resulting emulsion was adjusted to have pH of 6.5 and pAg of 7.5. Eight mg per mol of silver of sodium benzenethiosulfonate, 5 mg per mol of silver of sodium thiosulfate and 8 mg per mol of silver of chloroauric acid were added to the emulsion, which was then heated at 60° C. for 60 minutes for chemical sensitization. As a stabilizer, 150 mg of 1,3,3a,7-tetraazaindene was added thereto. The grains thus formed were cubic silver chlorobromide grains having a mean grain size of 0.27 μm and a silver chloride content of 60 mol %. The emulsion had a grain size fluctuation coefficient of 10%.

Preparation of Emulsion (C):

An aqueous 0.13M silver nitrate solution and an aqueous halide solution containing $1\times10^{-7}$ mol per mol of silver of $(NH_4)_3RhCl_6$ and $2\times10^{-7}$ mol per mol of silver of $K_3IrCl_6$ and containing 0.078M of potassium bromide and 0.052M of sodium chloride were added to an aqueous gelatin solution containing sodium chloride and 1,3-dimethyl-2-imidazolidinethione, with stirring at 45° C. over a period of 12 minutes, by a double jet method. Silver chlorobromide grains were formed having a mean grain size of 0.15 μm and a silver chloride content of 70 mol %, by nucleation. Subsequently, an aqueous 0.87M silver nitrate solution and an aqueous halide solution containing 0.522M of potassium bromide and 0,348M of sodium chloride were added thereto by the same double jet method over a period of 20 minutes.

Next, $1\times10^{-3}$ mol of KI solution was added to the silver halide emulsion for halogen-conversion, and the resulting emulsion was washed with water by conventional flocculation. Forty g of gelatin was added thereto, and the resulting emulsion was adjusted to have pH of 6.5 and pAg of 7.5. Eight mg per mol of silver of sodium benzenethiosulfonate, 5 mg per mol of silver of sodium thiosulfate and 8 mg per mol of silver of chloroauric acid were added to the emulsion, which was then heated at 60° C. for 60 minutes for chemical sensitization. As a stabilizer, 150 mg of 4-hydroxy-6-methyl-1,3,3a,7-tetraazaindene was added thereto. The grains thus formed were cubic silver chlorobromide grains having a mean grain size of 0.27 μm and a silver chloride content of 40 mol %. The emulsion had a grain size fluctuation coefficient of 11%.

Preparation of Emulsion (D):

An aqueous 1M silver nitrate solution and an aqueous halide solution containing $1.2\times10^{-7}$ mol per mol of silver of $(NH_4)_3RhCl_3$ and potassium iodide and potassium bromide were simultaneously added to an aqueous gelatin solution kept at 50° C. in the presence of ammonia, over a period of 60 minutes, whereupon the pAg value of the reaction system was kept at 7.8. As a result, a cubic monodispersed emulsion having a mean grain size of 0.25 μm and a mean silver iodide content of 1 mol % was prepared, which was then de-salted by flocculation. Next, 40 g of gelatin was added thereto, the resulting emulsion was adjusted to have pH of 6.0 and pAg of 8.5. Five mg of sodium thiosulfate and 6 mg of chloroauric acid were added thereto, and the emulsion was heated at 60° C. for 60 minutes for chemical sensitization. As a stabilizer, 150 mg of 4-hydroxy-6-methyl-1,3,3a,7-tetraazaindene was added thereto. The emulsion formed had a grain size fluctuation coefficient of 9%.

Emulsion (A) prepared above was divided into several parts. A sensitizing dye of 5-{[3-(4-sulfobutyl)-5-chloro-2-benzooxazolidylidene]ethylidene}-1-hydroxyethoxyethyl-3-(2-pyridyl)-2-thiohydantoin ($1\times10^{-3}$ mol per mol of silver), a short-wave cyanine dye having the following structural formula (a) ($5\times10^{-4}$ mol per mole of silver), a water-soluble latex of the following formula (b) (200 mg/m$^2$), a dispersion of polyethyl acrylate (200 mg/m$^2$), a hardening agent of 1,3-divinylsulfonyl-2-propanol (200 mg/m$^2$), hydrazine compound (II-7) of the present invention ($1\times10^{-4}$ mol/mol of Ag), hydrazine compound (II-19) of the present invention ($1\times10^{-6}$ mol/mol of Ag) and a compound of formula (I) of the present invention were added to each of the thus divided parts, as indicated in Table 1 below.

(a)

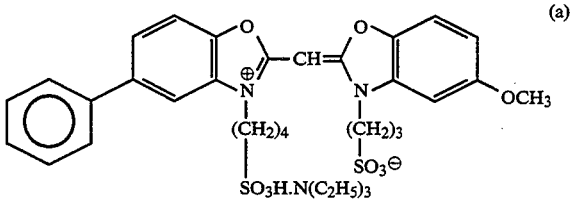

(b)

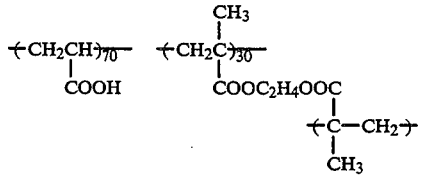

Preparation of Redox Compound-Containing Emulsion Layer:

An aqueous 1.0M silver nitrate solution and an aqueous halide solution containing $3\times10-7$ mol per mol of silver of $(NH_4)_3RhCl_6$ and containing 0.3M of potassium bromide and 0.74M of sodium chloride were added to an aqueous gelatin solution containing sodium chloride and 1,3-dimethyl-2-imidazolidinedione, with stirring at 45° C. by a double jet method, over a period of 30 minutes. Silver chlorobromide grains were formed having a mean grain size 0.28 μm and a silver chloride content of 70 mol %. The emulsion thus formed was then rinsed with water by a conventional flocculation method. Forty g of gelatin was added to the emulsion, which was then adjusted to have pH of 6.5 and pAg of 7.5. Five mg per mol of silver of sodium thiosulfate and 8 mg per mol of silver of chloroauric acid were added to the emulsion, which was then heated at 60° C. for 60 minutes for chemical sensitization. As a stabilizer, 150 mg of 4-hydroxy-6-methyl-1,3,3a,7-tetrazaindene was added to the sensitized emulsion. The grains thus formed were cubic silver chlorobromide grains having a mean grain size of 0.28 μm and a silver chloride content of 70 mol %. The emulsion has a grain size fluctuation coefficient of 10%.

The emulsion thus prepared were divided into several parts. To each part were added a sensitizing dye of 5-{[3-(4-sulfobutyl)-5-chloro-2-benzooxazolidylidene]ethylidene}-1-hydroxyethoxyethyl-3(2-pyridyl)-2-thiohydantoin ($1\times10^{-3}$ mol per mol of silver), a dispersion of polyethyl acrylate (50 mg/m$^2$), 1,2-bis(vinylsulfonylacetamido)-ethane (40 mg/m$^2$) and a redox compound of the present invention (as indicated in Table 1 below).

On a support was coated the hydrazine-containing layer as a lowermost layer (Ag 3.6 g/m$^2$; gelatin 2 g/m$^2$); then the redox-containing layer (Ag 0.4 g/m$^2$; gelatin 0.5 g/m$^2$) was coated thereover via an interlayer (gelatin 0.5 g/m$^2$); and a protective layer comprising gelatin (1.0 g/m$^2$), a matting agent of amorphous $SiO_2$ having a grain size of about 3.5 μm (40 mg/m$^2$), methanol silica (0.1 g/m$^2$), polyacrylamide (100 mg/m$^2$), hydroquinone (200 mg/m$^2$), silicone oil and, as a coating aid, a fluorine-containing surfactant ($C_8F_{17}SO_3N(C_3H_7)$-$CH_2COOK$, and sodium dodecylbenzenesulfonate was coated as an outermost layer. Accordingly, the various samples identified in Table 1 below were prepared. The samples were evaluated with respect to the photographic properties and the results obtained are shown in Table 1. In addition, a backing layer and a back protecting layer each having the composition mentioned below were also coated on the back surface of the support.

| | |
|---|---|
| Composition of Backing Layer: | |
| Gelatin | 3 g/m$^2$ |
| Polyethyl Acrylate Latex | 2 g/m$^2$ |
| Surfactant (Sodium P-dodecylbenzenesulfonate) | 40 mg/m$^2$ |
| Gelatin Hardening Agent ($CH_2{=}CHSO_2CH_2CONH{-}(CH_2)_2{-}CONHCH_2SO_2CH{=}CH_2$) | 110 mg/m$^2$ |
| Dye Mixture of (a), (b) and (c) | |
| (a) | 50 mg/m$^2$ |
| (b) | 100 mg/m$^2$ |
| (c) | 50 mg/m$^2$ |
| Composition of Back Protecting Layer: | |
| Gelatin | 0.8 mg/m$^2$ |
| Fine Polymethyl Methacrylate Grains (mean grain size) | 30 mg/m$^2$ |
| Sodium Dihexyl-α-sulfosuccinate | 15 mg/m$^2$ |
| Sodium Dodecylbenzenesulfonate | 15 mg/m$^2$ |
| Fluorine-containing Surfactant ($C_8H_{17}SO_2N(C_3H_7){-}CH_2COOK$) | 5 mg/m$^2$ |
| Sodium Acetate | 40 mg/m$^2$ |

Dyes (a) to (c) used above are as follows:

Dye (a):

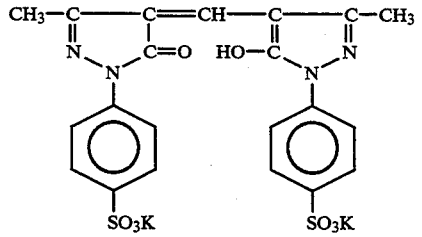

Dye (b):

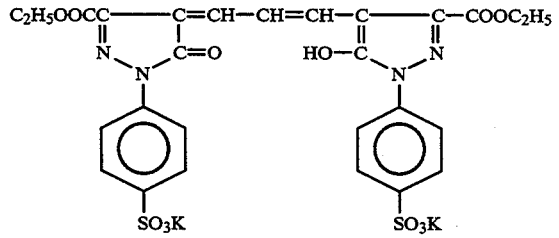

-continued

Dye (c):

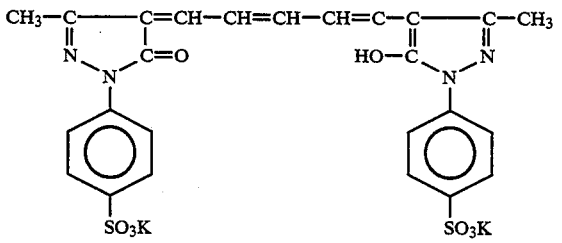

As is apparent from the results shown in Table 1 below, the photographic material samples (Nos. 7 to 17) of the present invention all showed good results with respect to their photographic characteristics and their line image quality. In addition, the samples of the present invention were free from black pepper. Evaluation of the samples were effected as described below.

Determination and Evaluation of Photographic Characteristics:

Samples were processed with a developer having the composition mentioned above, using FG-660F Model automatic developing machine (manufactured by Fuji Photo Film Co.), at 34° C. for 30 seconds, for determining and evaluating photographic characteristics thereof. Fixation of the developed samples was effected by the use of a commercial fixer GR-F1.

The sensitivity referred to herein indicates a relative value of the reciprocal of an exposure amount of giving a density of 1.5 by 30 second development at 34° C., based on Sample No. 1 having a sensitivity of 100.

The "γ" value as referred to herein is defined by the following formula:

$$\gamma = (3.0-0.3)/[\log(\text{exposure amount of giving density } 3.0) - \log(\text{exposure amount of giving density } 0.3)]$$

Regarding formation of black pepper, the background part of each sample as developed at 34° C. for 40 seconds was observed with a microscope, whereupon the observed part was evaluated by 5-rank evaluation. Precisely, "5" is the best and "1" is the worst. "5" and "4" indicate practical samples; "3" indicates an inferior sample which is practicable with difficulty; and "2 and "1" indicate impractical samples. An intermediate between "4" and "3" was represented by "3.5".

Evaluation of Line Image Quality:

An original having photo-typeset 7-grade Ming-style letters and Gothic-type letters having a reflection density of falling within the range of from 0.5 to 1.2 was photographed on each sample, using a camera (DSC351 Model, manufactured by Dai-Nippon Screen Co., Ltd. ), and the exposed samples were developed under the same condition as mentioned above (34° C., 30 seconds). The processed results were evaluated by 5-rank evaluation, in which "5" is the best and "1" is the worst. "5" and "4" indicate practical samples; "3" indicates an inferior sample which is practicable with difficulty; and "2 and "1" indicate impractical samples.

TABLE 1

| Sample Number | Redox Compound Compound | Redox Compound Amount Added (mol/mol-Ag) | Compound of Formula (I) Compound | Compound of Formula (I) Amount Added (mol/mol-Ag) | Photographic Characteristics Sensitivity | Photographic Characteristics $\gamma$ | Photographic Characteristics $D_{max}$ | Line Image Quality | Black Pepper | |
|---|---|---|---|---|---|---|---|---|---|---|
| 1 | — | — | — | — | 115 | 20 | 5.5 | 1 | 1 | |
| 2 | III-9 | $3 \times 10^{-3}$ | — | — | 100 | 16 | 5.3 | 4 | 2 | |
| 3 | — | — | I-14 | $5 \times 10^{-5}$ | 117 | 19 | 5.5 | 1 | 1.5 | |
| 4 | — | — | I-18 | $5 \times 10^{-5}$ | 115 | 19 | 5.5 | 1 | 1.5 | |
| 5 | — | — | I-28 | $5 \times 10^{-5}$ | 112 | 18.5 | 5.4 | 1 | 1.5 | |
| 6 | — | — | I-50 | $5 \times 10^{-5}$ | 112 | 19 | 5.5 | 1 | 1.5 | |
| 7 | III-9 | $3 \times 10^{-3}$ | I-14 | $5 \times 10^{-5}$ | 102 | 15.8 | 5.2 | 5 | 5 | Invention |
| 8 | III-9 | $3 \times 10^{-3}$ | I-18 | $5 \times 10^{-5}$ | 100 | 16 | 5.3 | 5 | 5 | Invention |
| 9 | III-9 | $3 \times 10^{-3}$ | I-18 | $1 \times 10^{-4}$ | 98 | 15.2 | 5.2 | 5 | 5 | Invention |
| 10 | III-9 | $3 \times 10^{-3}$ | I-28 | $5 \times 10^{-5}$ | 105 | 16.6 | 5.4 | 5 | 5 | Invention |
| 11 | III-9 | $3 \times 10^{-3}$ | I-28 | $1 \times 10^{-4}$ | 102 | 15.6 | 5.3 | 5 | 5 | Invention |
| 12 | III-9 | $3 \times 10^{-3}$ | I-50 | $5 \times 10^{-5}$ | 100 | 15.8 | 5.2 | 5 | 5 | Invention |
| 13 | III-15 | $4 \times 10^{-3}$ | I-14 | $5 \times 10^{-5}$ | 98 | 15.4 | 5.3 | 5 | 5 | Invention |
| 14 | III-15 | $4 \times 10^{-3}$ | I-18 | $5 \times 10^{-5}$ | 100 | 15.8 | 5.3 | 5 | 5 | Invention |
| 15 | III-15 | $4 \times 10^{-3}$ | I-18 | $1 \times 10^{-4}$ | 102 | 16.0 | 5.3 | 5 | 5 | Invention |
| 16 | III-15 | $4 \times 10^{-3}$ | I-28 | $5 \times 10^{-5}$ | 100 | 15.3 | 5.3 | 5 | 5 | Invention |
| 17 | III-15 | $4 \times 10^{-3}$ | I-50 | $5 \times 10^{-5}$ | 98 | 15.0 | 5.4 | 5 | 5 | Invention |
| 18 | III-9 | $3 \times 10^{-3}$ | Comparative Compound (a) | $5 \times 10^{-5}$ | 102 | 16.1 | 5.4 | 4 | 1.5 | |
| 19 | III-9 | $3 \times 10^{-3}$ | Comparative Compound (b) | $5 \times 10^{-5}$ | 105 | 16.2 | 5.4 | 4 | 1 | |

Comparative Compound (a)

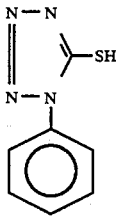

Comparative Compound (b)

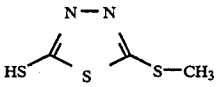

EXAMPLE 2

Using emulsions (A) to (D) and the same additives as those used in Example 1, photographic material samples Nos. 20 to 39 (each having the same layer constitution as that in Example 1) were prepared. These were processed in the same manner as in Example 1 and then evaluated in the same manner as in Example 1. The results obtained are shown in Table 2 below.

As apparent from the results in Table 2, the samples of the present invention (Nos. 21, 22, 24, 26, 27, 29, 31, 32, 34, 36, 37 and 39) had good properties. In particular, emulsions (A) and (B) each having a silver chloride content of 50 mol % or more were found to yield good properties with respect to the sensitivity, $\gamma$ value and Dmax value.

TABLE 2

| Sample Number | Emulsion | Redox Compound Compound | Redox Compound Amount Added (mol/mol-Ag) | Compound of Formula (I) Compound | Compound of Formula (I) Amount Added (mol/mol-Ag) | Photographic Characteristics Sensitivity | Photographic Characteristics $\gamma$ | Photographic Characteristics $D_{max}$ | Line Image Quality | Black Pepper | |
|---|---|---|---|---|---|---|---|---|---|---|---|
| 20 | A | III-9 | $3 \times 10^{-3}$ | — | — | 100 | 16 | 5.3 | 4 | 2 | |
| 21 | A | III-9 | $3 \times 10^{-3}$ | I-18 | $1 \times 10^{-4}$ | 100 | 16 | 5.3 | 5 | 5 | Invention |
| 22 | A | III-9 | $3 \times 10^{-3}$ | I-28 | $1 \times 10^{-4}$ | 102 | 15.6 | 5.3 | 5 | 5 | Invention |
| 23 | A | III-11 | $1 \times 10^{-3}$ | — | — | 98 | 15.6 | 5.2 | 4 | 2 | |
| 24 | A | III-11 | $1 \times 10^{-3}$ | I-28 | $1 \times 10^{-4}$ | 100 | 15.4 | 5.2 | 5 | 5 | Invention |
| 25 | B | III-9 | $3 \times 10^{-3}$ | — | — | 105 | 15.0 | 5.2 | 4 | 2 | |
| 26 | B | III-9 | $3 \times 10^{-3}$ | I-18 | $1 \times 10^{-4}$ | 102 | 14.8 | 5.2 | 5 | 5 | Invention |
| 27 | B | III-9 | $3 \times 10^{-3}$ | I-28 | $1 \times 10^{-4}$ | 102 | 15.0 | 5.2 | 5 | 5 | Invention |
| 28 | B | III-11 | $1 \times 10^{-3}$ | — | — | 102 | 14.6 | 5.1 | 4 | 2 | |
| 29 | B | III-11 | $1 \times 10^{-3}$ | I-28 | $1 \times 10^{-4}$ | 100 | 14.8 | 5.2 | 5 | 5 | Invention |
| 30 | C | III-9 | $3 \times 10^{-3}$ | — | — | 107 | 14.6 | 5.0 | 4 | 1 | |
| 31 | C | III-9 | $3 \times 10^{-3}$ | I-18 | $1 \times 10^{-4}$ | 105 | 14.0 | 4.5 | 5 | 4 | Invention |
| 32 | C | III-9 | $3 \times 10^{-3}$ | I-28 | $1 \times 10^{-4}$ | 105 | 14.2 | 4.6 | 5 | 4 | Invention |
| 33 | C | III-11 | $1 \times 10^{-3}$ | — | — | 105 | 13.8 | 4.4 | 4 | 1 | |
| 34 | C | III-11 | $1 \times 10^{-3}$ | I-28 | $1 \times 10^{-4}$ | 105 | 13.6 | 4.4 | 5 | 4 | Invention |
| 35 | D | III-9 | $3 \times 10^{-3}$ | — | — | 102 | 14.0 | 4.8 | 4 | 1 | |
| 36 | D | III-9 | $3 \times 10^{-3}$ | I-18 | $1 \times 10^{-4}$ | 100 | 14.0 | 4.3 | 4 | 4 | Invention |
| 37 | D | III-9 | $3 \times 10^{-3}$ | I-28 | $1 \times 10^{-4}$ | 98 | 13.6 | 4.3 | 5 | 4 | Invention |
| 38 | D | III-11 | $1 \times 10^{-3}$ | — | — | 96 | 13.0 | 4.2 | 4 | 1 | |
| 39 | D | III-11 | $1 \times 10^{-3}$ | I-28 | $1 \times 10^{-4}$ | 96 | 13.0 | 4.2 | 5 | 4 | Invention |

EXAMPLE 3

The same procedure as in Example 1 was repeated, except that the combination of hydrazine compounds (II-7) amd (II-19) was replaced by a combination of hydrazine compounds (II-13) and (II-8) or a combination of hydrazine compounds (II-20) and (II-21). The same good results as before were obtained.

EXAMPLE 4

The samples of Examples 1 to 3 were processed in accordance with the procedure indicated therein, except that developer (A) having the following composition was used. The same results as before were obtained.

| Developer (A): | |
|---|---|
| Hydroquinone | 50.0 g |
| N-methyl-p-aminophenol | 0.3 g |
| Sodium Hydroxide | 18.0 g |
| 5-Sulfosalicylic Acid | 30.0 g |
| Boric Acid | 20.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-mercaptotetrazole)benzene-sulfonate | 0.2 g |
| 6-Dimehtylamino-1-hexanole | 4.0 g |
| Sodium Toluenesulfonate | 15.0 g |
| Water to make | 1 liter |
| Potassium Hydroxide to make | pH of 11.7 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, wherein the emulsion layer or at least one other hydrophilic colloid layer contains at least one hydrazine derivative, at least one redox compound capable of releasing a development inhibitor by an oxidation product of a developing agent, and at least one mercapto-heterocyclic compound represented by one of the following formulas (IV), (V) and (VI):

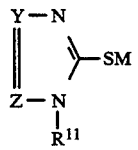

(IV)

wherein Y and Z each represents N or $CR^{12}$; $R^{12}$ represents a hydrogen atom, an alkyl group, or a substituted or unsubstituted aryl group;

$R^{11}$ represents at least one organic group selected from the group consisting of an alkyl group having from 1 to 20 carbon atoms, an aryl group having from 6 to 20 carbon atoms, or an alkyl or aryl group containing a linking group selected from the group consisting of —S—, —O—, —N=, —CO—, —SO— and —$S_2$13 ; wherein $R^{11}$ has been substituted by at least one group selected from the group consisting of —$SO_3M$, —COOM, —$SO_2NHR^1$, —NHCONHRO$^1$, —$NHSO_2R^1$, —$CO_2NHR^1$, —$NHCOR^1$, —$PO_3M$ and —OH in which $R^1$ represents a hydrogen atom or an alkyl group having from 1 to 5 carbon atoms; M represents a hydrogen atom, an alkali metal, a quaternary ammonium group or a quaternary phosphonium group;

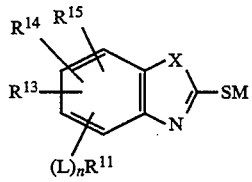

(V)

wherein X represents a sulfur atom, an oxygen atom, a selenium atom or —N($R^{16}$)—;

$R^{16}$ represents a hydrogen atom, an alkyl group, or an aryl group;

L represents —$CONR^{17}$—, —$NR^{17}CO$—, —$SO_2NR^{17}$—, —$NR^{17}SO_2$—, —OCO—, —COO—, —S—, —$NR^{17}$—, —CO—, —SO—, —OCOO—, —$NR^{17}CONR^{18}$—, —$NR^{17}COO$—, —$OCONR^{17}$— or —$NR^{17}$ $SO_2NR^{18}$—;

$R^{17}$ and $R^{18}$ each represents a hydrogen atom, a substituted or unsubstituted alkyl group, or a substituted or unsubstituted aryl group;

$R^{13}$, $R^{14}$ and $R^{15}$ each represents a hydrogen atom or a substitutable group;

n represents 0 or 1;

M represents a hydrogen atom, an alkali metal, a quaternary ammonium group or a quaternary phosphonium group;

and $R^{11}$ represents at least one organic group selected from the group consisting of an alkyl group having from 1 to 20 carbon atoms, an aryl group having from 6 to 20 carbon atoms, or an alkyl or aryl group containing a linking group selected from the group consisting of —S—, —O—, —N=, —CO—, —SO— and —$SO_2$—; wherein $R^{11}$ has been substituted by at least one group selected from the group consisting of —$SO_3M$, —COOM, —$SO_2NHR^1$, —NHCONHR$^1$, —NHSO $_2R^1$, —$CO_2NHR^1$, —NHCOR$^1$, —$PO_3M$ and —OH in which $R^1$ represents a hydrogen atom or an alkyl group having from 1 to 5 carbon atoms; and wherein $R^{11}$ is further substituted by a halogen atom, an alkoxy group, an aryloxy group, an alkyl group when $R^{11}$ is an aryl group, an aryl group when $R^{11}$ is an alkyl group, an amide group, a carbamoyl group, a sulfonamide group, a cyano group, an alkoxycarbonyl group, an aryloxycarbonyl group or a nitro group;

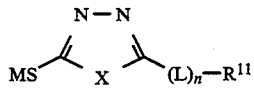

(VI)

wherein M represents a hydrogen atom, an alkali metal, a quaternary ammonium group or a quaternary phosphonium group;

$R^{11}$ has the same meaning as in formula (IV);

L represents —$CONR^{17}$—, —$NR^{17}CO$—, —$SO_2NR^{17}$—, —$NR^{17}SO_2$—, —OCO—, —COO—, —S—, —$NR^{17}$—, —CO—, —SO—, —OCOO—, —$NR^{17}CONR^{18}$—, —$NR^{17}COO$—, —$OCONR^{17}$— or —$NR^{17}SO_2NR^{18}$—;

$R^{17}$ and $R^{18}$ each represents a hydrogen atom, an alkyl group, or a substituted or unsubstituted aryl group;

n represents 0 or 1;

X represents a sulfur atom, an oxygen atom, a selenium atom or —N($R^{16}$)—;

and $R^{16}$ represents a hydrogen atom, a substituted or unsubstituted alkyl group, or an aryl group.

2. The silver halide photographic material as in claim 1, wherein the silver halide in the emulsion has a silver chloride content of 50 mol % or more based on the total silver halide content.

3. The silver halide photographic material as in claim 1, wherein the hydrazine derivative is represented by formula (II):

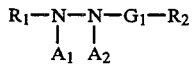

(II)

where $R_1$ represents an aliphatic group or an aromatic group;

$R_2$ represents a hydrogen atom, an alkyl group, an aryl group, an alkoxy group, an aryloxy group, an amino group, or a hydroxyl group;

$G_1$ represents —CO—, —$SO_2$—, —SO—, —$R_2$PO—,

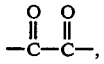

a thiocarbonyl group, or an iminomethylene group; and $A_1$ and $A_2$ are both hydrogen atoms, or one of them represents a hydrogen atom and the other represents an alkylsulfonyl group, an arylsulfonyl group, or an acyl group.

4. The silver halide photographic material as in claim 1, wherein the redox compound is represented by formula (R-1):

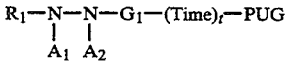

(R-1)

where $R_1$ represents an aliphatic group or an aromatic group;

$G_1$ represents —CO—,

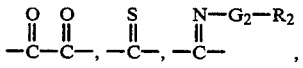

—SO—, —$SO_2$—or

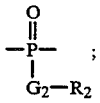

$G_2$ represents a mere chemical bond or represents —O—, —S— or —$NR_2$—;

$R_2$ represents a hydrogen atom or $R_1$;

$A_1$ and $A_2$ each represents a hydrogen atom, an alkylsulfonyl group, an arylsulfonyl group or an acyl group, provided that at least one of $A_1$ and $A_2$ must be a hydrogen atom, Time represents a divalent linking group, which may have a timing function; PUG represents a development inhibitor; and t represents 0 or 1.

5. The silver halide photographic material as in claim 1, wherein the redox compound is represented by formula (R-2):

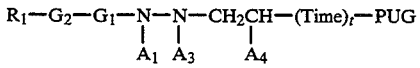

(R-2)

wherein $R_1$ represents an aliphatic group or an aromatic group;

$G_1$ represents —CO—,

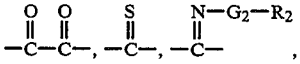

—$SO_2$— or

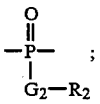

$A_1$ represents a hydrogen atom, an alkylsulfonyl group, an arylsulfonyl group or an acyl group, which may be substituted; $A_3$ represents a hydrogen atom, an alkylsulfonyl group, an arylsulfonyl group or an acyl group, or represents —$CH_2$—C($A_4$)H—(Time)$_t$—PUG; $A_4$ represents a nitro group, a cyano group, a carboxyl group, a sulfo group or —$G_1$—$G_2$—$R_1$;

$G_2$ represents a mere chemical bond or represents —O—, —S— or —$NR_2$—; $R_2$ represents a hydrogen atom or $R_1$; Time represents a divalent linking group, which may have a timing function; PUG represents a development inhibitor; and t represents 0 or 1.

6. The silver halide photographic material as in claim 1, wherein the redox compound is represented by formula (R-3):

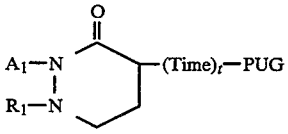

(R-3)

$R_1$ represents an aliphatic group or an aromatic group;

$A_1$ represents a hydrogen atom, an alkylsulfonyl group, an arylsulfonyl group or an acyl group;

Time represents a divalent linking group, which may have a timing function;

PUG represents a development inhibitor; and t represents 0 or 1.

7. The silver halide photographic material as in claim 1, wherein the hydrazine derivative is used in an amount of from $1\times10^{-6}$ mol to $5\times10^{-2}$ mol per mol of silver halide in the material.

8. The silver halide photographic material as in claim 1, wherein the redox compound is used in an amount of from $1\times10^{-6}$ mol to $5\times10^{-2}$ mol per mol of silver halide in the material.

9. The silver halide photographic material as in claim 1, wherein the compound represented by formula (I) is used in an amount of from $1.0\times10^{-6}$ mol to $5.0\times10^{-2}$ mol per mol of the silver in the material.

10. The silver halide photographic material as in claim 1, wherein the mercapto-heterocyclic compound is represented by formula (IV).

11. The silver halide photographic material as in claim 1, wherein the mercapto-heterocyclic compound is represented by formula (V).

12. The silver halide photographic material as in claim 1, wherein the mercapto-heterocyclic compound is represented by formula (VI).

13. The silver halide photographic material as in claim 1, wherein the material is black and white photographic material.

* * * * *